US007056638B1

(12) United States Patent
Tomita et al.

(10) Patent No.: US 7,056,638 B1
(45) Date of Patent: Jun. 6, 2006

(54) TONER FOR ELECTROPHOTOGRAPHY, DEVELOPER USING THE SAME, PROCESS CARTRIDGE USING THE SAME, IMAGE-FORMING APPARATUS USING THE SAME, AND IMAGE-FORMING PROCESS USING THE SAME

(75) Inventors: Masami Tomita, Shizuoka (JP); Toshiki Nanya, Shizuoka (JP); Fumihiro Sasaki, Shizuoka (JP); Shigeru Emoto, Shizuoka (JP); Shinichiro Yagi, Shizuoka (JP); Hiroto Higuchi, Shizuoka (JP); Naohiro Watanabe, Shizuoka (JP); Tadao Takikawa, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 273 days.

(21) Appl. No.: 10/645,804

(22) Filed: Aug. 22, 2003

(30) Foreign Application Priority Data

Aug. 26, 2002 (JP) ..... 2002-245932
Jan. 22, 2003 (JP) ..... 2003-014045

(51) Int. Cl.
*G03G 9/08* (2006.01)

(52) U.S. Cl. ..... 430/108.8; 430/110.3; 430/111.4; 430/126; 399/328

(58) Field of Classification Search ..... 430/108.4, 430/108.8, 110.3, 111.4, 126; 399/328
See application file for complete search history.

(56) References Cited

U.S. PATENT DOCUMENTS

| | | | | |
|---|---|---|---|---|
| 5,935,751 | A | 8/1999 | Matsuoka et al. | |
| 6,057,076 | A * | 5/2000 | Berkes et al. | 430/137.18 |
| 6,593,048 | B1 | 7/2003 | Sasaki et al. | |
| 6,653,037 | B1 | 11/2003 | Sawada et al. | |
| 6,660,443 | B1 | 12/2003 | Sugiyama et al. | |
| 6,756,175 | B1 * | 6/2004 | Yamada et al. | 430/124 |
| 6,800,412 | B1 * | 10/2004 | Sugiyama et al. | 430/108.1 |
| 6,846,604 | B1 * | 1/2005 | Emoto et al. | 430/110.3 |

FOREIGN PATENT DOCUMENTS

| | | |
|---|---|---|
| EP | 1 186 960 | 3/2002 |
| JP | 2002-6541 | 1/2002 |

OTHER PUBLICATIONS

Patent Abstracts of Japan, JP 2002-169336, Jun. 14, 2002.

* cited by examiner

*Primary Examiner*—John L Goodrow
(74) *Attorney, Agent, or Firm*—Oblon, Spivak, McClelland, Maier & Neustadt, P.C.

(57) ABSTRACT

The present invention is directed to a toner for electrophotography that exhibits excellent hot offset resistance, storability, and glossiness and can obtain a high image-resolution and highly detailed images when used for energy saving apparatuses or as a color toner. The present invention is also directed to a developer, image-forming apparatus, and process cartridge containing such toner, and image-forming process using such toner. The toner of the present invention contains a resin and wax. The wax is dispersed within the resin in a shaped of fine particles to form a toner particle. In the toner particle, more dispersed wax particles are existed in a surface portion of the toner particle than a centric portion of the toner particle.

25 Claims, 8 Drawing Sheets

TONER FOR ELECTROPHOTOGRAPHY, DEVELOPER USING THE SAME, PROCESS CARTRIDGE USING THE SAME, IMAGE-FORMING APPARATUS USING THE SAME, AND IMAGE-FORMING PROCESS USING THE SAME

BACKGROUND OF THE INVENTION

1. Field of the Invention

The present invention relates to a tone for a developer, which develops latent electrostatic images in electrophotography, electrostatic recording, electrostatic printing and the like. The present invention also relates to an image-forming apparatus and image-forming process using the toner. Specifically, the present invention relates to a toner, developer, developing apparatus for electrophotography, which are used for copiers, laser printers, facsimiles for plain paper and the like using a direct or indirect electrophotographic developing system. Further, the present invention is directed to a toner for electrophotography, an image-forming apparatus (developing apparatus) and a process cartridge which are used for full-color copiers, full-color laser printers, full-color plain paper facsimiles and the like using a direct or indirect electrophotographic multicolor developing system.

2. Description of the Related Art

In electrophotography, electrostatic recording, electrostatic printing and the like, a developer is, for example, applied to an latent electrostatic image bearing member, e.g., a photoconductor or the like, so as to dispose the developer onto a latent electrostatic image formed on the latent electrostatic image bearing member in a developing step, the developer disposed on the image is transferred to a recording medium, e.g., a recording paper, or the like in a transferring step, thereafter the transferred developer is fixed on the recording medium in a fixing step. As such developer used for developing the latent electrostatic image formed on the latent electrostatic image, it is commonly known to use single-component developers such as magnetic toner and non-magnetic toner, which do not require a double-component developer consisting of a carrier and a toner, or a carrier. As dry toners used in electrophotography, electrostatic recording, electrostatic printing or the like, conventional toners are one which is formed by melting and kneading a toner binder (binder resin) such as styrene resin, polyester or the like, colorants, and the like together, then pulverizing the mixture.

These dry toners are, after used for developing and transferred on a sheet of paper or the like, fixed on the sheet by heating and melting the toner using a heat roller. If a temperature of the heat roller is overly high, in this procedure, a problem, so called "offset" occurs. Offset is the problem that the toner is excessively melted and adhered onto the heat roller. If a temperature of the heat roller is overly low, on the other hand, a problem arises in that a degree of melting the toner is insufficient, resulted in insufficient fixing. Accordingly, there are demands in a toner having a higher temperature to cause offset (excellent hot offset resistance) and a low fixing temperature (excellent fixing ability at low temperature), while energy conservation, miniaturization of apparatuses such as copiers are considered on the other hand. Toners also require a heat-resistant storability that suppresses blocking of toner when the toner is stored, and at a temperature of atmosphere within the apparatus where the toner is accommodated. Especially, low melting viscosity of toner is essential in full-color copiers, full-color printers in order to obtain gloss and color mixture of an image. As a consequence, polyester toner binders exhibiting sharp melting has been used in such toner. However, this toner tends to cause offset. To prevent offset, in apparatuses for full-color, silicone oil or the like has conventionally been applied on the heat roller. Yet, the method of applying silicone oil or the like to the heat roller has a problem in that the apparatuses need to equip an oil tank and an oil applier, therefore the apparatuses become more complex in their structures and large in their size. It also leads a deterioration of the heat roller, so maintenance is required at every arbitrary term. Further, it is unavoidable that the oil is attached to copier paper, films for OHP (over head projector) and the like, and especially with the films for OHP, there is a problem in that the attached oil cases deterioration in color tone.

Owing to prevent a toner fusion without applying an oil to a heat roller, wax is added to a toner. In this method, however, mold-releasing effect is largely affected from a condition of dispersed wax within a toner binder. Wax does not exhibit its mold-releasing ability if the wax is compatible with a toner binder. Wax exhibits its mold-releasing ability and improves mold-releasing ability of toner when the wax stays within a toner binder as incompatible domain particles. If a diameter of domain particles is excessively big, there is a problem in that excellent images cannot be obtained. This is caused by an increase in a ratio of wax existed in a surface portion of a toner with respect to other component of the toner, related to an increase in the diameter thereof. Therefore, the toner exhibits an aggregation hence impair fluidity. Moreover, filming occurs where wax migrates to a carrier or a photoconductor during long-term use. Yet there is a problem in that color reproducibility and clearness of an image are impaired in the case of color toner. On the contrary, if a diameter of the domain particle is overly small, the wax is excessively dispersed so that sufficient mould-releasing ability cannot be obtained. Although it is necessary to control a diameter of wax as mentioned above, an appropriate method thereof has not been found yet. For example, in the case of toners manufactured by pulverization, control of wax diameter largely relies upon shear force of mixing during melting and kneading. Polyester resin, which has commonly been used for a toner binder, has a low viscosity hence sufficient shear force cannot be added thereto. Consequently, it is very difficult to control distribution of wax and to obtain a suitable diameter especially for these toners.

Another problem of pulverization is that more wax is exposed to a surface of toner since the wax tends to have broken edges in its shape.

Although improvement of toners has been attempted by miniaturize a diameter of toner particle or narrowing particle diameter distribution of toner in order to obtain high quality images, uniform particle shape cannot be obtained by ordinary manufacturing methods of mixing pulverization. Moreover, the toner is still pulverized so that overly fine toner particles are generated, in a course of mixing with carrier in a developing member of the apparatus, or, by a contact stresses between a developing roller, and a toner applying roller, a layer thickness controlling blade, or a friction charging blade. These lead deterioration of image quality. In addition, a superplasticizer embedded on the surface of toner also leads deterioration of image quality. Further, fluidity of the toner particles is insufficient because of shapes of the toner particle, and thus a large amount of the superplasticizer is required or a filling factor of the toner into a toner bottle becomes low. Accordingly, these are considered to be factors that inhibit a miniaturization of apparatuses.

Yet there is a problem in that missing portions can be found in the transferred image and an amount of the toner consumption becomes large to cover the missing portions in the transferred image. This is due to the impaired transferring ability caused by that a process of transferring, in which an image formed by multicolor toner is transferred to a recording medium or a sheet of paper, is complicated in order to form full-color image, and the toner has non-uninformed particle diameter, such as in a case of a pulverized toner.

Accordingly, a strong demand has arisen in obtaining high quality images which do not have any missing part by further improving transfer efficiency leading to a reduction in an amount of toner consumption, and also reducing running cost. If transfer efficiency is remarkably excellent, a cleaning unit, which removes remained toner on a photoconductor or a transfer after transferring, can be omitted form an apparatus. Therefore, the apparatus can be miniaturized and low const thereof can be achieved together with having a merit of reducing a disposed toner. Hence, various methods for manufacturing a spherical toner have been suggested in order to overcome the defects caused by a non-uniformly shaped toner.

Hitherto, extensive studies have been done to improve a quality of toner. It has been known that a mold-releasing agent (wax) having a low melting point, e.g., polyolefine, is added to a toner in order to improve fixing ability at low temperature and offset resistance. For example, Japanese Patent Application Laid-Open (JP-A) Nos. 6-295093, 7-84401, and 9-258471 disclose toners that contain wax having a certain endothermic peak by DSC (differential scanning calorimetry). However, the toners disclosed the above patent publications still need to improve fixing ability at low temperature, offset resistance and also developing ability.

Also, JP-A Nos. 5-341577, 6-123999, 6-230600, and 6-324514 disclose candelilla wax, higher fatty acid wax, higher alcohol wax, vegetable wax (carnauba, rice), montan ester wax and the like as a mold-releasing agent of toner. However, the toners disclosed in the above patent publications still need to improve developing ability (charging ability) and durability. If the mould releasing agent having a low softening point is added to a toner, fluidity of the toner is decreased hence developing ability or transferring ability is also decreased. Moreover, charging ability, durability and storability of the toner prone to be affected thereby.

JP-A Nos. 11-258934, 11-258935, 4-299357, 4-337737, 6-208244, and 7-281478 disclose toners which contain two or more mold-releasing agents in order to enlarge a fixing region (non offset region). However these toners still have a problem in uniform dispersion of the mold-releasing agents within a toner particle.

JP-A No. 8-166686 discloses a toner which contains polyester resin and two types of offset inhibitors each having different acid values and softening points. However, these toners still have problem in developing ability. Moreover, JP-A Nos. 8-328293, and 10-161335 disclose a toner that defines a dispersion diameter of wax within the toner particle. However, there is a case that sufficient mold-releasing ability of the toner cannot be exhibited during fixing since a condition or positioning of the dispersed wax is not defined in the toner particle.

Furthermore, JP-A No. 2001-305782 discloses a toner in which spherical wax particles are fixed onto the surface of toner. However, the wax particles positioned on the surface of toner decreases fluidity of the toner and thus developing ability or transferring ability of the toner is also decreased. In addition, charging ability, durability, and storability of the toner also prone to be affected. JP-A No. 2002-6541 discloses a toner in which wax is included in the toner particle and the wax is located in the surface portion of the toner particle. However, there is a case that all of offset resistance, storability, and durability of the toner are insufficient.

Generally, a toner is manufactured by methods of kneading pulverization in which a thermoplastic resin is melted and mixed together with a colorant, and a mold-releasing agent or a charge control agent may further added depending on the cases, so as to make a mixture, and then the mixture is pulverized and graded. Further, depending on the cases, inorganic or organic fine particles are added onto the surface of toner particle in order to improve fluidity or cleaning ability. In ordinal methods of kneading pulverization, a shape and surface structure of toner particle are non-uniformed. Although it depends on crushability of materials and conditions of pulverizing step, it is not easy to control a shape and surface structure of toner particle arbitrarily. Also, it is difficult to narrow particle diameter distribution of a toner due to a limitation of grading performance and an increased cost thereby. Regarding a pulverized toner, it is a great task to control an average particle diameter of toner particle diameter distribution to a small particle diameter, especially 6 μm or less, from the viewpoint of yield, productivity and cost.

Along with wide spread of electrophotographic technology, not only a demand for obtaining more detailed and high quality image formation, but also a demand for high-speed, small lightweight, simple handling apparatus and multimode copy with a small number of sheet have arisen. As electrophotographic apparatuses has been more commonly applied for home use or personal use, not only office use, there is a demand especially in small light weight of apparatus, simplification of handling when copying with small number of sheets. In an image-forming apparatus using electrophotographic technology, a charger, a light irradiator and an image developer, which are disposed around a photoconductor, sequentially perform charging, light irradiating, and developing onto the photoconductor. When the charger performs charging, the image developer is already raised and starts an operation required for sufficiently charging a developer or the like, so as to ready for an operation of developing. This operating condition of the image developer is hold at a certain period so as to ready for a cycle of continuous copying. When a relatively small number of sheets of copying, i.e., one or a few sheets, is performed as in the case of home use or personal use, a toner contained in a developer is likely to have more chances to receive mechanical stress of stirring or the like. Further, a demand for a high-speed apparatus in recent years leads a rapid rise of apparatuses. This means that a toner has more chances to receive stronger mechanical stress by a rapid stirring with a short time or the like and an apparatus is more likely to receive an intensive thermal stress therein as a result of a rapid rise and high-speed operations of the apparatus.

In the case of a toner that is formed by kneading a resin and wax, the wax is included in the resin, and is stayed as fine particles. This is due to a reason that the wax generally shows poor compatibility with the resin. Another reason is that the wax exhibits mold-releasing ability only when the wax is stayed in the resin as incompatible domain particles, but the wax does not exhibit mold-releasing ability when the wax is compatible with the resin. However, the toner is easily grinded in smaller particles by mechanical stress cased by stirring or the like. The toner tends to be grinded in smaller particles when an intensive thermal stress is added to the toner, i.e., when the toner is rapidly heated. This is because the wax has a different coefficient of thermal expansion from that of the resin, generally the coefficient of thermal expansion of the wax (excluding microcrystalline wax) is 3% to 10% higher than the coefficient of thermal expansion of the resin since most types of wax tend to be rapidly crystallized through the state of amorphous. It is widely known that these overly grinded toner particles cause various inconveniences.

Apart from the inconveniences, there is also a problem when a developer containing a toner is used for a long term. In such developer, a consumption rate of toner particles varies depending on a diameter of the toner particle. Generally, a larger diameter of the toner particle tends to be consumed more rapidly than a smaller diameter of the toner particle. Therefore, a composition of the toner changes from the initial toner composition, and the composition of the toner may end up with having a large amount of small toner particles.

JP-A No. 2002-6541 is an excellent from the viewpoint that it discloses a necessity in that wax is included in a toner particle and the wax is located in a surface portion of the toner particle, in order to solve a problem of thermal stability during storage caused by the wax having a low melting point being located on a surface of the toner. However, this patent publication does not teach a problem of overly miniaturized toner particles by mechanical and thermal stresses added to the toner during the operations, and the undesirable relationship between the resin and the wax as mentioned above. The above patent publication does not suggest a manner to solve the problem neither.

For the purpose of positioning the wax in the surface portion of the toner particle in the technique disclosed in the above patent application, for example, the prepared slurry at 125° C. is quickly cooled down to 25° C. within ten seconds. Although an existing amount of wax in a toner is not mentioned therein, there is a description about the existing amount of wax only in examples which is showing that the existing amount of wax is less than 1% with respect to a toner particle. From this figure, it is easily imaged that the existing amount of wax is too small to exhibit mold-releasing effect, though it is attempted by bleeding the wax out to a surface of the fixing member so as to prevent a toner fusion thereon during fixing, and thus margin of hot offset is omitted.

As has been mentioned, wax included in a toner particle affects on a degree of toner fusion and fixing ability depending on a pulverizing state of the toner particle. However, it is difficult to control pulverization of toner particles and is further difficult to control a state of the included wax with foreseeing a state of pulverized toner particle.

If wax is not uniformly dispersed in a toner particle and only existed in a surface portion of the toner particle, an amount of the wax existed around the surface of the toner particle is large, and thus the toner particle prone to fuse on a carrier or the like. If wax is uniformly dispersed in a toner particle including a surface portion of the toner particle, on the other hand, a part of the surface portion of the toner particle where the wax does not exist becomes overly large, mold-releasing ability of the toner is insufficient during developing, transferring and cleaning compared with the expectation, and the toner particle prone to be crushed by mechanical or thermal stress. In addition, there is also a possibility that a characteristic of newly crushed fine toner particle is not desirable.

SUMMARY OF THE INVENTION

It is therefore an object of the present invention to provide a toner, which has an improved fixing ability at low temperature and offset resistance with low electric power consumption, forms a high quality toner image, and has an excellent long-term storability.

It is another object of the present invention to provide a toner, which can achieve high quality image and has a wide fixing region. It is also an object of the preset invention, in a case of a color toner, to provide a toner, which is excellent in glossiness and has an excellent offset resistance.

Further, it is another object of the present invention to provide a toner, which is capable of forming a highly defined image with high resolution. It is also an object of the present invention, in a case that a toner is used in a high-speed apparatus, to provide a toner, which realizes inhabitation of toner fusion by bleeding an appropriate amount of wax, and an excellent fixing ability even when toner particles are crushed by mechanical impacts between the toner particles with carrier, developing members, or the like during developing.

Yet it is another object of the present invention to provide a developer, image-forming apparatus, process cartridge, and image-forming process using the toner of the present invention.

The inventors has been achieved the present invention as a result of an intensive studies for improving a toner which has a wide fixing region, particle fluidity in the case of a toner having a small particle diameter, an excellent transferability, heat-resistant storability, low temperature fixing ability, cracking resistance, and substantially unchangeable characteristics when a toner particle is crushed or cracked. Especially, the study has been done for improving a toner which has an excellent glossiness when being used in a full-color copier, and does not require an application of oil to a heat roller.

The toner of the present invention comprises a resin and wax dispersed in the resin in a shape of fine particles so as to form a toner particle, in which more dispersed wax particles are placed in a surface portion of the toner particle than in a centric portion of the toner particle.

The developer of the present invention comprises the toner of the present invention.

The image-forming apparatus of the present invention comprises an image developer containing the toner of the present invention, and a fixer containing a pair of rollers. In this image-forming apparatus, a recording medium carrying an image formed of the toner is passed through between the pair of rollers where a bearing stress (load of the rollers/contact area) of $1.5\times10^5$ Pa is applied so that the toner is heated and melted, then the image is fixed onto the recording medium.

The process cartridge of the present invention comprises a photoconductor, and at least one of a charger, an image developer containing the toner of the present invention, and a cleaner. The process cartridge of the present invention is replaceable from an image-forming apparatus.

The image-forming process of the present invention comprises a step of charging a photoconductor by externally applying a voltage; a step of forming a latent electrostatic image on the charged photoconductor; a step of developing the latent electrostatic image with the toner of the present invention so as to form a toner image; a step of transferring the toner image onto a recording material by a transfer; a step of cleaning a surface of the photoconductor by a cleaner after the step of transferring; and a step of fixing the toner image on a recording medium by passing the recording medium between a pair of rollers.

DESCRIPTION OF THE PREFERRED EMBODIMENTS

Figure 1A:
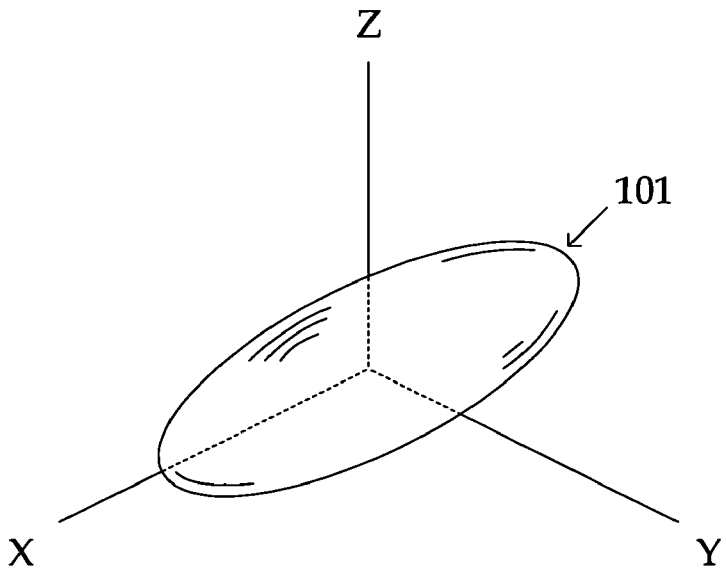
FIGS. 1A, 1B, and 1C are diagrams explaining a relation between a major axis, a minor axis, and a thickness of an example of a toner particle of the toner of the present invention.

The inventors of the present invention have succeeded to provide a toner in which wax particles are stably dispersed with a suitable particle diameter, and a process for manufacturing the toner. In O/W type emulsion, wax is affected by a water existed around the wax since the wax is hydrophobic, the wax is pushed towards a resin as a toner binder, which is also hydrophobic, and thereafter the wax is penetrated into the hydrophobic resin which is melted and softened. It is preferred not to adjust a penetration speed of the wax very high (not to use a high solubility solvent or not to heat at very high temperature). As a result, a degree of penetration of the wax to the resin has some sort of grade in depth direction since there is a difference in number of parlor group between the wax and the resin even though both are hydrophobic. Moreover, bonding sites of parlor group of the resin (particularly a modified polyester) occur negative absorption at interference with the wax. It is assumed that this leads stable dispersion of low polarity of the wax. In addition, by leaving the emulsion to stand for example at 35° C. to 45° C. for 30 minutes to 120 minutes, especially in the method of obtaining the toner in which a toner composition is dissolved or swollen/dispersed in an organic solvent, and dispersed in an aqueous solvent so as to form toner particles, such effect is achieved that wax particles are selectively positioned at vicinity of the surface of the toner particle as high polarity bonding sites exhibits hydrophilic to a water, but wax particles are prevented from exposing to the surface.

The dispersed wax particles are positioned gradually from a surface portion to a centric portion of the toner particle. Here, an existing amount of the wax in the surface portion is higher than an existing amount of the wax in the centric portion. As a consequence, wax is sufficiently bled out during fixing hence a fixing oil is not required. If more dispersed wax particles are existed in the centric portion of the toner particle, it is difficult to bleed the wax out from the toner particle during fixing. By suitably dispersing wax in the toner particle, desirable bleeding of wax without over bleeding is realized. The inventors of the present invention observed the cross-section of the toner and the recording medium after fixing, and confirmed that some wax remained in the toner particles after fixing. The toner of the present invention exhibits excellent resistance, stability and storability under an ordinal usage condition since hardly any wax is appeared on the surface of the toner particle.

These effects can be performed when an occupied area ratio of the wax is about 5% to about 40% in a region on an arbitrary cross-section having a center of the toner particle thereon. The "region" is defined as a region that is positioned between a circumference of the arbitral cross-section and an inner circumference having a radius which is two-third of a radius of the circumference. Moreover, these effects can be particularly obvious when an existing amount of wax in the above region is 70% by number or more.

When the concentrate of wax in the surface portion is smaller than the existing amount of wax in the centric portion and the occupied area ratio of the wax is less than 5% in the above region, it is difficult to bleed the wax out from the toner particle even though a large amount of the wax is existed inner side of the toner particle. Hence, hot offset resistance becomes insufficient in such cases. When the occupied area ratio of the wax is more than 40% in the above region, the wax is overly bled from the surface of the toner particle hence thermal resistance and durability become insufficient.

By dispersing wax particles of 70% by number or more in the above region, moreover, the wax enables to be sufficiently and stably bled during fixing and oil-free fixing is adequately performed.

The distribution of dispersed wax particle diameter in the toner of the present invention is that 70% number or more of wax particles have a diameter of 0.1 μm to 3 μm, and preferably that 70% by number or more of wax particles have a diameter of 1 μm to 2 μm. When large number of wax particles have a diameter of less than 0.1 μm, it is difficult to bleed the wax out from the toner particle hence sufficient mold-releasing property cannot be obtained. When large number of wax particles has a diameter of more than 3 μm, the wax tends to be overly bled from the toner particle. Over bleeding of wax leads aggregation of toner particles, which results in insufficient fluidity, an occurrence of filming, and severely impaired color reproductively, and glossiness in the case of a color toner.

In the present invention, a "diameter of a dispersed wax particle" is defined as the largest diameter of the dispersed wax particle among the whole dispersed wax particles in the toner particle. The diameter of a dispersed wax particle is measures by following method in the present invention. Specifically, toner particles were disposed into an epoxy resin and then the epoxy resin was cured. The epoxy resin embedding the toner particles was very finely sliced so as to obtain a thin slice having a thickness of approximately 100

μm. The toner particles within the thin slice were dyed with ruthenium trioxide. Thereafter, the thin slice was observed under a transmission electron microscope (TEM) at a magnification of 10,000 times, and pictures of the toner particles were taken. Twenty pictures (20 toner particles) were visually evaluated, dispersing conditions of the wax were observed therefrom, and a diameter of the dispersed wax particle was measured. Existing amount, occupied ratio, and number of the wax or wax particles were also measured by the identical method.

An occupied area ratio of the wax in the region on an arbitral cross-section having the center of the toner particle is the existence proportion of the wax showing with an area ratio, in which the region is positioned between a circumference of the arbitral cross-section and an inner circumference having a radius which is two-third of a radius of the circumference. The wax, which does not position on the surface of the toner particle but position in the surface portion of the toner particle, is defined as follow. Namely, in the above-mentioned pictures, such wax is the dispersed wax particles, which are positioned in a region between a circumference of the toner particle, i.e., a surface of the toner particle, and an inner circumference having a two-third radius of the circumference. When wax particles are positioned on the inner circumference, such wax particles are regarded as being positioned in a centric portion of the toner particle.

The proportion of the wax existed in the surface portion and the centric portion of the toner particle can be directly measured by any known methods in art. In the present invention, however, the existing amount of the wax in the surface portion and the centric portion of the toner particle can be measured by an occupied area ratio of the wax on the cross-section of the toner particle, or by counting the number of dispersed wax particles in the surface portion and the centric portion of the toner particle, which is a much simpler method compared to any known methods in arts.

In the present invention, "a surface portion of a toner particle" is defined as a region positioned between a circumference of the toner particles and an inner circumference that has a radius which is two-third of the radius of the circumference. Also, "a centric portion of a toner particle" is defined as a region positioned between the inner circumference and a center of the toner particle.

In the present invention, the content of the wax in the toner is preferably about 3 parts by weight to about 5 parts by weight relative to 100 parts by weight of the resin. When the content of the wax in the toner is less than about 3 parts by weight relative to 100 parts by weight of the resin, the amount of the wax is too small to obtain adequate mold-releasing property thus enough margin for offset cannot be obtained, although the wax is bled out from the toner particle to a surface of a fixing member during fixing thus the toner particle does not adhere to the fixing member. When the content of the wax in the toner is about 10 parts by weight relative to 100 parts by weight of the resin, on the other hand, the wax is easily affected from thermal energy and mechanical energy as the wax is melted at low temperature. Therefore, the wax tends to be fallen apart from the surface of the toner particle when the toner and carrier are stirred in an image developer, so that the wax is adhered to the carrier surfaces and impair charging ability of the carrier.

An endothermic peak of the wax measured by differential scanning calorimeter (DSC) with increasing temperature, is preferably about 65° C. to about 115° C. in terms of capability of low temperature fixing. When the melting point of the wax is lower than about 65° C., fluidity of the toner is poor. When the melting point of the toner is higher than about 115° C., the fixing ability of the toner is poor.

The technical effects can be obtained by smoothly bleeding the wax out to the surface of the toner particle. Owing to attain a function as a mold-releasing agent, the wax is preferably free fatty acid eliminated carnauba wax, rice wax or ester wax each having an acid value of 5 KOHmg/g or less.

"Modified polyester" in the present invention refers to a polyester having a bonding other than an ester bonding therein, or, a polyester having a structurally different resin component therein with covalent bondings, ionic bondings, or the like. The example thereof includes polyester whose terminal is reacted with, other than ester bondings. Specifically, the polyester in which functional groups capable of reacting with acid radicals and hydroxyl groups, for example isocyanate groups and the like, are introduced to the terminal of the polyester and thereafter the terminal are further reacted with an active hydrogen compound so as to modify the terminal of the polyester.

Suitable example of modified polyester used in the present invention is a reactant of a polyester pre-polymer having an isocyanate group (A) and amines (B). Examples of the polyester pre-polymer having an isocyanate group (A) may include a reactant that is a polycondensation product of polyol (1) and poly carboxylic acid (2), and also a reactant of the polyester having an active hydrogen compound and polyisocyanate (3). Examples of the active hydrogen to be contained may include a hydroxyl group (an alcoholic hydroxyl group and a phenolic hydroxyl group), an amino group, a carboxy group, a mercapto group, and the like. Of these, an alcoholic hydroxyl group is preferable.

Examples of the polyol (1) include diol (1—1) and polyol having 3 or more valences (1-2). These are suitably used singly or in combination of the diol (1—1) and a little amount of the polyol having 3 or more valences (1-2). Examples of the diol (1—1) include alkylene glycol such as ethylene glycol, 1,2-propylene glycol, 1,3-propylene glycol, 1,4-butane diol, 1,6-hexane diol or the like; alkylene ether glycol such as diethylene glycol, triethylene glycol, dipropylene glycol, polyethylene glycol, polypropylene glycol, poly tetramethylene ether glycol or the like; alicyclic diol such as 1,4-cyclohexane dimethanol, hydrogenated bisphenol A, or the like; bisphenols such as bisphenol A, bisphenol F, bisphenol S, or the like; an adduct of the alicyclic diol with alkylene oxide such as ethylene oxide, propylene oxide, butylene oxide, or the like; an adduct of the bisphenols with alkylene oxide such as ethylene oxide, propylene oxide, butylene oxide, or the like. Of these, the alkylene glycol having carbon atoms of 2 to 12, and the adduct of the bisphenols with the alkylene oxide are preferable. A combination of the alkylene glycol having carbon atoms of 2 to 12 and the adduct of the bisphenols with the alkylene oxide is particularly preferable. Examples of the polyol having 3 or more valences (1-2) include polyhydric aliphatic alcohol such as glycerine, trimethylolethane, trimethylolpropane, pentaerythritol, sorbitol, or the like; phenols having 3 or more valences such as trisphenol PA, phenol novolak, cresol novolak, or the like; and an adduct of the polyphenol having 3 or more valences with alkylene oxide.

Examples of polycarboxylic acid (2) include dicarboxylic acid (2-1) and polycarboxylic acid having 3 or more valences (2—2). The dicarboxylic acid (2-1) may suitably be used singly or in a combination with a little amount of the polycarboxylic acid having 3 or more valences (2—2). Examples of the dicarboxylic acid (2-1) include alkylene carboxylic acid such as succinic acid, adipic acid, sebacic acid, or the like; and alkenylene dicarboxylic acid such as maleic acid, fumaric acid, or the like; aromatic dicarboxylic acid such as phthalic acid, isophthalic acid, terephthalic acid, naphthalene dicarboxylic acid, or the like. Of these, the alkenylene carboxylic acid having carbon atoms of 4 to 20 and the aromatic dicarboxylic acid having carbon atoms of 8 to 20 are preferable. Examples of the polycarboxylic acid having 3 or more valences (2—2) include aromatic polycarboxylic acid having carbon atoms of 9 to 20 such as trimellitic acid, pyromellitic acid, or the like. As the polycarboxylic acid (2), furthermore, acid anhydrate of the above listed examples or lower alkyl ester such as methyl ester, ethyl ester, isopropyl ester or the like can be used to react with polyol (1).

A ratio of polyol (1) to polycarboxylic acid (2) is, in terms of equivalent ratio of hydroxyl group to carboxyl group ([OH]/[COOH]), generally about 2/1 to about 1/1, preferably 1.5/1 to 1/1, and more preferably 1.3/1 to 1.02/1.

Examples of polyisocyanate (3) include aliphatic polyisocyanate such as tetramethylene diisocyanate, hexamethylene diisocyanate, 2,6-diisocyanate methylcaproate, or the like; alicyclic polyisocyanate such as isophorone diisocyanate, cycrohexylmethane diisocyanate, or the like; aromatic diisocyanate such as tolylene diisocyanate, diphenylmethane diisocyanate, or the like; aromatic aliphatic diisocyanate such as α,α,α',α'-tetramethylxylene diisocyanate, or the like; isocyanurates; a block-compound in which the polyisocyanate is blocked with phenol derivatives, oxime, caprolactom, or the like; and a combination of two or more thereof.

A ratio of polyisocyanate (3) is, in terms of equivalent ratio of isocyanate group to hydroxyl group ([NCO]/[OH]), generally about 5/1 to about 1/1, preferably 4/1 to 1.2/1, and more preferably 2.5/1 to 1.5/1. When the ratio [NCO]/[OH] is more than about 5, fixing ability at low temperature is impaired. When the mole ratio of [NCO] is less than about 1, the urea content of the modified polyester is low hence hot offset resistance is impaired. In the pre-polymer having an isocyanate group at the terminal thereof (A), a content of polyisocyanate (3) composition is generally about 0.5% by weight to about 40% by weight, preferably 1% by weight to 30% by weight, and more preferably 2% by weight to 20% by weight. When the content of polyisocyanate (3) composition is less than about 0.5% by weight, not only impairing hot offset resistance, it is also difficult to have heat-resistant storability together with fixing ability at low temperature. When the content is more than about 40% by weight, on the other hand, fixing ability at low temperature is impaired.

The number of isocyanate group contained in the prepolymer having an isocyanate group (A) per molecular, is generally one or more, preferably 1.5 to 3 in average, and more preferably 1.8 to 2.5 in average. When the number of isocyanate group per molecular is less than one, the molecular weight of urea-modified polyester becomes low, and therefore, hot offset resistance is impaired.

Examples of the amines (B) include diamine (B1), polyamine having 3 or more valences (B2), amino alcohol (B3), amino mercaptan (B4), amino acid (B5), and a block compound in which the amino group of (B1) to (B5) is blocked (B6). Examples of the diamine (B1) include aromatic diamine such as phenylene diamine, diethyltoluene diamine, 4,4'-diaminophenylmethane, or the like, alicyclic diamine such as 4,4'-diamino-3,3'-dimethyldicycrohexylmethane, diamine cyclohexane, isophorone diamine, or the like, and aliphatic diamine such as ethylene diamine, tetramethylene diamine, hexamethylene diamine or the like. Examples of the polyamine having 3 or more valences include ethylene triamine, triethylene tetramine. Examples of amino alcohol (B3) include ethanolamine, hydroxyethylaniline or the like. Examples of amino mercaptan (B4) include aminomethylmercaptan, aminopropylmercaptan, or the like. Examples of amino acid (B5) include amino propionic acid, amino capric acid, or the like. Examples of the block compound in which the amino group of (B1) to (B5) is blocked (B6) include a ketimine compound, an oxazoline compound, or the like obtained from amines and ketones of (B1) to (B5) such as acetone, methylethylketone, methylbutylketone or the like. Of the amines (B) listed above, the diamine (B1) and a combination of the diamine (B1) and a little amount of polyamine (B2) are preferably.

Further, the molecular weight of the urea-modified polyester may be adjusted by using an elongation inhibitor, if required. As the elongation inhibitor, monoamine such as diethyl amine, dibutyl amine, butyl amine, lauryl amine, or the like can suitably be used.

The ratio of the amines (B) is, in terms of equivalent ratio of isocyanate group in the pre-polymer having an isocyanate group (A) to amino group in the amines (B) ([NCO]/[NHx]), generally about 1/2 to about 2/1, preferably 1.5/1 to 1/1.5, and more preferable 1.2/1 to 1/1.2. When the equivalent ratio [NCO]/[NHx] is more than about 2, or, less than about 1/2, the molecular weight of the urea-modified polyester is low, therefore, hot offset resistance is impaired. In the present invention, the urea-modified polyester may contain urethane bondings together with urea bondings. The mole ratio of urea bonding content to urethane bonding content is generally about 100/0 to about 10/90, preferably 80/20 to 20/80, and more preferable 60/40 to 30/70. When the mole ratio of the urea bonding content is less than 10, hot offset resistance is impaired.

The urea-modified polyester (u) used in the present invention is manufactured by one-shot process or pre-polymer process. The weight average molecular weight of the urea-modified polyester (u) is generally about 10,000 or more, preferable 20,000 to 10,000,000, and more preferably 30,000 to 1,000,000. When the above range is attained, the peak molecular weight of the urea-modified polyester (u) is about 1,000 to about 10,000. When the peak molecular weight is less than about 1,000, an elongation reaction tends not to occur and elasticity of the toner is low, hence hot offset resistance is impaired. When the peak molecular weight is more than about 10,000, on the other hand, fixing ability is impaired and problems related to manufacturing may occur for example in formation of particles or pulverization. The number average molecular weight of the urea-modified polyester (u) is not particularly limited, especially when unmodified polyester (LL) is used in combination therewith as described later, any number average molecular weight can be used to obtain the above-mentioned range of the weight average molecular weight. In the case that the urea-modified polyester (u) is used singly, the number average molecular weight is generally about 20,000 or less, preferably 1,000 to 10,000, and more preferably 2,000 to 8,000. When the number average molecular weight is more that about 20,000, fixing ability and glossiness of a toner used for a full-color apparatus are impaired.

In the present invention, not only singly, but the modified polyester by a urea bonding (u) is used in combination with an unmodified polyester (LL) as a resin (toner binder). It is more preferable to use the urea-modified polyester together with the unmodified polyester (LL) than to use the urea-modified polyester singly, from the viewpoints of improvement of low temperature fixing ability and glossiness of the toner for a full-color apparatus. Examples of the unmodified polyester (LL) include a polycondensation product of the polyol (1) and the polycarboxylic acid (2), having an identical polyester composition of the urea-modified polyester (u), and the like and suitable examples thereof are also identical to those of the urea-modified polyester (u). In addition, the unmodified polyester (LL) may also be a polyester which is modified by a chemical bonding other than an urea bonding, for example a polyester modified with an urethane bonding. It is preferable that the urea-modified polyester and the unmodified polyester are compatible at least a part thereof from the viewpoint of low temperature fixing ability and hot offset resistance. Accordingly, it is preferred that the unmodified polyester (LL) has a similar component to the polyester component of the urea-modified polyester (u). The weight ratio (u/LL) of the urea-modified polyester (u) to the unmodified polyester (LL) is, in the case that the unmodified polyester (LL) in contained together with the urea-modified polyester (u), generally about 5/95 to about 80/20, preferably 5/95 to 30/70, and more preferable 7/93 to 20/80. When the weight ratio of the urea-modified polyester is less than 5, not only impairing hot offset resistance, it is also difficult to obtain heat-resistant storability together with low temperature fixing ability.

The peak molecular weight of the unmodified polyester (LL) is generally about 1,000 to about 10,000, preferably 2,000 to 8,000, and more preferably 2,000 to 5,000. When the peak molecular weight thereof is less than about 1,000, heat-resistant storability is impaired. When the peak molecular weight thereof is more than about 10,000, on the other hand, low temperature fixing ability is impaired. The hydroxyl value of the unmodified polyester (LL) is preferably about 5 or more, more preferably 10 to 20, and further preferably 20 to 80. When the hydroxyl value thereof is less than about 5, it is difficult to obtain heat resistance storability together with fixing ability at low temperature. The acid value of the unmodified polyester (LL) is about 1 to about 5, and preferable 2 to 4. Since the wax having a high acid value is generally used as a wax, which is a component of the toner, it is preferable to use the resin having a low acid value as a toner binder from the viewpoints of a charge and high volume resistivity. Thus the toner formed from such wax and resin is suitable for a double component toner.

The glass transition temperature (Tg) of the resin used in the present invention, is generally about 40° C. to about 70° C., and preferably 55° C. to 65° C. When the glass transition temperature (Tg) of the resin is less than about 50° C., heat resistant storability is impaired. When the glass transition temperature (Tg) thereof is more than about 70° C., on the other hand, low temperature fixing ability is insufficient. By containing the urea-modified polyester, the toner of the present invention has excellent heat-resistant storability, even with the low glass transition temperature thereof, with comparison to known polyester toners in the art.

As a colorant used in the present invention, any known dyes and pigments can be used. Examples thereof may include carbon black, nigrosine dyes, black iron oxide, Naphthol Yellow S, Hansa Yellow (10G, 5G, G), cadmium yellow, yellow iron oxide, yellow ochre, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, red oxide, red lead oxide, red lead, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone, and mixtures thereof. The content of the colorant is about 1% by weight to about 15% by weight, and preferably 3% by weight to 10% by weight, relative to the total weight of the toner.

The colorant for use in the present invention may be used as a master batch being combined with a resin. Such resin used for the preparation of the master batch or in kneading with the master batch, includes, in addition to the above-mentioned modified and unmodified polyester resins, polymers of styrene and substituted styrenes such as polystyrene, poly-p-chlorostyrene, polyvinyl toluene, or the like; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic ester copolymer, or the like; poly(methyl methacrylate), poly(butyl methacrylate), poly(vinyl chloride), poly(vinyl acetate), polyethylenes, polypropylenes, polyesters, epoxy resins, epoxy polyol resins, polyurethanes, polyamides, poly(vinyl butyral), polyacrylic acid resin, rosin, modified rosin, terpene resins, aliphatic or alicyclic hydrocarbon resins, aromatic petroleum resins, chlorinated paraffin, paraffin wax, and the like. Each of these can be used singly or in combination of two or more.

The master batch used for the present invention can be obtained by mixing and kneading a resin for master batch and the colorant with high shear force. To improve interaction between the colorant and the resin, an organic solvent can be used. In addition, the master batch is preferably prepared by a "flushing process". In the flushing process, a water-based paste containing the colorant and water is mixed and kneaded with the resin and an organic solvent so that the colorant moves towards the resin, and that water and the organic solvent are removed. According to this process, a wet cake containing the colorant can be used without drying. The materials are preferably mixed and kneaded using a triple roll mill and other high-shear dispersing devices.

The toner for the present invention may contain a charge-controlling agent, if needed. As the charge-controlling agent, any charge-controlling agents in the art can be used. Examples thereof may be a nigrosine dye, a triphenylmethane dye, a chromium-containing metal complex dye, a molybdic acid chelate pigment, a rhodamine dye, an alkoxyamine, a quaternary ammonium salt (including a fluorine-modified quaternary ammonium salt), alkylamide, a simplex or a compound of phosphorus, a simplex or a compound of tungsten, a fluorine-containing activator, a metallic salt of salicylic acid, a metallic salt of a salicylic acid derivative, and the like. Specific examples thereof are BONTRON 03 of a nigrosine dye, BONTRON P-51 of a quaternary ammonium salt, BONTRON S-34 of a metal containing azo dye, BONTRON E-82 of an oxynaphthoic acid metal complex, BONTRON E-84 salicylic acid metal complex, BONTRON E-89 of a phenol condensation product (manufacture by Orient Chemical Industries, Ltd.); TP-302, TP-415 of molybdenum complex of quaternary ammonium salt (manufactured by Hodoya Chemical Co., Ltd.); Copy Charge PSY VP2038 of a quaternary ammonium salt, Copy Blue PR of a phenyl methane derivative, Copy Charge NEG VP2036, Copy Charge NX VP434 of a quaternary ammonium salt (manufactured by Hoechst Japan Ltd.); LRA-901, and LR-147 of a boric acid complex (manufactured by Japan Carlit Co., Ltd.); copper phthalocyanine, perylene, quinacridone, azo dyes, polymeric compounds having a functional group such as a sulfonic group, a carboxyl group, a quaternary ammonium salt, and the like.

The charge-controlling agent content of the toner of the present invention is not particularly limited and can be adjusted depending on a type of the resin, with or without an additive used if required, a process for manufacturing the toner including a dispersion process. Suitable content of the charge-controlling agent is preferable about 0.1 parts by weight to about 10 parts by weight, and more preferably 0.2 parts by weight to 5 parts by weights, relative to 100 parts by weight of the resin. When the content thereof is more than about 10 parts by weight, the charging ability of the toner becomes overly large, the effect of the main charge-controlling agent is impaired, electrostatic attraction between the toner and the developing roller is overly increased, fluidity of the developer is decreased, and the image density is decreased. These charge-controlling agent and the mold-releasing agent can be melted and kneaded together with the master batch and the resin, and can also be added when the ingredients are melted and dispersed in an organic solvent.

In order to enhance fluidity, developing ability, and charging ability of the base toner particle formed in the process of manufacturing the toner of the present invention, external additive is added. As the external additive, inorganic particles are suitably used. The primary particle diameter of the inorganic particle is preferable about 5 nm to about 2 μm, and more preferably 5 nm to 500 nm. The specific surface thereof in terms of BET method is preferably about 20 $m^2/g$ to about 500 $m^2/g$. The content of the inorganic particle is preferably about 0.01% by weight to about 5% by weight, and more preferably 0.01% by weight to 2.0% by weight, relative to the total weight of the toner. Specific examples of the inorganic toner include silica, aluminum, titanium oxide, barium titanate, magnesium titanate, calcium titanate, strontium titanate, zinc oxide, tin oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, silicon nitride, and the like.

Another examples of the external additive may be polymeric particles such as polystyrene formed from soap-free emulsion polymerization, suspension polymerization, and dispersion polymerization; copolymers of methacrylic ester and acrylic ester; polycondensation thermosetting resins such as silicone, benzoguanamine, and nylon.

A surface treatment is suitably performed on these polymeric particles as a superplasticizer so that hydrophobic property is improved and fluidity and charging ability are inhibited from being impaired even in a high humidity atmosphere. Suitable surface treatment agents are, for example, a silane coupling agent, a silylation reagent, a silane coupling agent having an alkyl fluoride group, an organic titanate coupling agent, an aluminium coupling agent, a silicone oil, a modified silicone oil, and the like.

A cleaning agent may also be added in order to remove the developer remained on a photoconductor or on a primary transfer after transferring. Suitable cleaning agents are, for example, zinc stearate, calcium stearate, fatty acid metal salt, such as stearic acid, polymeric particles formed by soap-free emulsion polymerization, such as polymethyl methacrylate particles, polystyrene particles, or the like. The polymeric particles preferably have relatively narrow particle diameter distribution and volume average particle diameter of about 0.01 μm to about 1 μm.

The process for manufacturing the toner of the present invention will be described hereinafter.

The resin as a toner binder is manufactured by the following process.

The polyol (1) and polycarboxylic acid (2) are heated at a temperature of from 150° C. to 280° C., under the presence of known esterification catalyst such as tetrabuthoxytitanate, dibutyl tinoxide, or the like. Thereafter, the mixture thereof is decompressed if required, while the generated water in a course of decompressing is removed, so as to yield polyester having a hydroxyl group. Then, the polyester having a hydroxyl group is reacted with polyisocyanate (3) at a temperature of from 40° C. to 140° C. so as to yield a pre-polymer having an isocyanate group (A). Further, the pre-polymer having an isocyanate group (A) is reacted with amines (B) at a temperature of from 0° C. to 140° C. so as to yield polyester modified with a urea bonding. When the polyisocyanate (3) is reacted, and the pre-polymer having an isocyanate group (A) is reacted with the amines (B), solvents may be used, if required. Usable solvents are, for example, solvents which are inactive with the isocyanate (3), such as aromatic solvents, e.g., toluene, xylene; ketones, e.g., acetone, methylethylketone, methylisobutylketone; esters, e.g., ethyl acetate; amides, e.g., dimethylformamide, dimethylacetoamide; and ethers, e.g., tetrahydrofuran. In the case that the polyester unmodified with an urea bonding (LL) is used in a combination with the urea-modified polyester (u), the unmodified polyester (LL) is prepared in a same manner of the polyester having a hydroxyl group, and then the polyester having a hydroxyl group is dissolved and mixed into the solution after the completion of the reaction of the urea-modified polyester (u).

The toner of the present invention can suitably be prepared by the following procedure, but not limited thereto.

When preparing a developer, the above-mentioned inorganic particles, e.g., hydrophobic silica particles, can be added in order to improve fluidity, storability, developing ability, and transferring ability of the developer. Such addition of external additive is carried out with any conventional powder mixer. Especially, it is preferable to use the mixer that equips a jacket or the like and is capable of controlling the interior temperature. In order to modify the negative charging state given to the additive, it may be added in middle of the process or gradually during the process. The number of revolution, gyration speed, time and temperature may of course be varied. At first, a strong charge may be given followed by a relatively weak charge, or the reverse may be done.

Preferable examples of mixing devices include V-shaped mixer, rocking mixer, Redige mixer, Nauta mixer, Henschel mixer and the like.

The toner of the present invention can be prepared by dissolving or dispersing components of the toner to an organic solvent and dispersing this solvent to an aqueous medium. As the aqueous medium, water is used singly, or in combination with a solvent mixable with water. Examples of the solvent mixable with water include alcohols such as methanol, isopropanol, ethylene glycol, or the like; dimethyl amide; tetrahydrofuran; cellosolves such as methylcellosolve, or the like; lower ketones such as acetone, methylethylketone, or the like.

To obtain a toner particle, dispersion formed of pre-polymer having an isocyanate group (A) may be reacted with amines (B) in an aqueous medium, or already prepared a urea-modified polyester (u) may be used. As a method for forming stable dispersion formed of the urea-modified polyester (u) or the pre-polymer (A) in an aqueous medium, such method is used that dispersing the urea-modified polyester (u) or pre-polymer (A) using shear force. The pre-polymer (A) and other toner components, e.g., a colorant, a colorant master batch, a mold-releasing agent, a charge-controlling agent, an unmodified polyester (also refer to "toner raw materials" hereinafter), can be mixed together when dispersion is formed in an aqueous medium. However, it is more preferable that the toner raw materials are mixed together, followed by adding the mixture of the toner raw materials to the aqueous medium so as to disperse. Moreover, other toner components such as a colorant, a mold-releasing agent, a charge-controlling agent and the like, are not necessary to be mixed when forming particles in an aqueous medium, and they can be added to particles after the particles are formed. For example, particles are formed without including a colorant, and thereafter a colorant is added by conventional dyeing method.

The method of dispersing is not particularly limited, but conventional apparatuses of low-speed shearing, high-speed shearing, frictioninig, high pressure jet, ultrasonic wave, or the like are suitably used. Of these, the high-speed shearing apparatus is preferable in order to control a particle diameter of dispersion in a range of 2 μm to 20 μm. There is no limitation on a number of revolution, when the high-speed shearing apparatus is used, but the number of revolution is generally about 1,000 rpm to about 30,000 rpm, and preferably 5,000 rpm to 20,000 rpm. The dispersion time is, when a batch mixer is used, generally about 0.1 minutes to about 5 minutes, though it is not limited thereto. The temperature during dispersing is generally about 0° C. to about 150° C. (under the pressure), and preferably 40° C. to 98° C. High temperature is more preferable from the viewpoints of low viscosity of dispersion that is formed of urea-modified polyester (u) or pre-polymer (A), and dispersibility.

Usage amount of the aqueous medium is generally about 50 parts by weight to about 20,000 parts by weight, and preferably 100 parts by weight to 1,000 parts by weight, relative to 100 parts by weight of the toner composition including urea-modified polyester (u) or pre-polymer (A). When the usage amount is more than 20,000, the cost efficiency is impaired. A dispersing agent can also be added, if needed. It is preferably to use the dispersing agent from viewpoints of sharp particle diameter distribution and stability of dispersion.

An oil phase, in which the toner composition is dispersed, is emulsified and dispersed in a liquid containing water by using a dispersing agent. Examples of such dispersing agent include anion surfactants such as alkylbenzene sulfonate, α-olefin sulfonate, phosphoric ester or the like; cationic surfactants such as amine salt surfactants, e.g., alkylamine salt, amino alcohol fatty acid derivatives, polyamine fatty acid derivatives, imidazolin, quaternary ammonium salt surfactants, e.g., alkyltrimethyl ammonium salt, dialkyldimethyl ammonium salt, alkyldimethylbenzyl ammonium salt, pyridinium salt, alkyl isoquinolinium salt, benzenthonium chloride; nonionic surfactants such as fatty acid amide derivatives, polyhydric alcohol derivatives and the like; and amphoteric surfactants such as alanine, dodecyl(aminoethyl) glycine, di(octylaminoethyl)glycine, N-alkyl-N,N-dimethylammoniumbetaine, and the like.

Moreover, a surfactant having a fluoroalkyl group is preferable in that an effect thereof can be attained with only a little usage amount. Examples of suitably anionic surfactant having a fluoroalkyl group include fluoroalkyl carboxylic acid having carbon atoms of 2 to 10 and metal salts thereof, disodium perfluorooctane sulfonylglutamate, sodium 3-[ω-fluoroalkyl(C6-C11)oxy]-1-alkyl(C3-C4)sulfonate, sodium 3-[ω-fluoroalkyl(C6-C8)-N-ethylamino]-1-propane sulfonate, fluoroalkyl(C11-C20)carboxylic acid, metal salts thereof, perfluoroalkyl carboxylic acid (C7-C13) and metal salts thereof, perfluoroalkyl(C4-C12)sulfonate and metal salts thereof, perfluorooctanesulfonic acid diethanolamide, N-propyl-N-(2-hydroxyethyl) perfluorioctane sulfonamide, perfluoroalkyl(C6-C10)sulfonamide propyltrimethylammonium salt, perfluoroalkyl(C6-C10)—N-ethylsulfonyl glycine salt, monoperfluoroalkyl(C6-C16) ethylphosphate and the like.

Examples of commercially available products thereof are Surflon S-111, S-112, S-113 (manufactured by Asahi Glass Co., Ltd.), Fluorad FC-93, FC-95, FC-98, FC-129 (manufactured by Sumitomo 3M Limited), UNIDAYNE DS-101, DS-102 (manufactured by Daikin Industries, Ltd.), MEGAFACE F-110, F-120, F-113, F-191, F-812, F-833 (manufactured by Dainippon Ink and Chemicals Incorporated), Ektop EF-102, 103, 104, 105, 112, 123A, 123B, 306A, 501, 201, 204 (manufactured by Tohkem Products Corporation), and Ftergent F-100, F-150 (manufactured by Neos Co., Ltd.) and the like.

Examples of the cationic surfactant include primary, secondary or tertiary amines having a fluoroalkyl group, quaternary ammonium salts of fatty acids such as perfluoroalkyl (C6 to C10) sulfonamide propyltrimethylammonium salt, or the like; benzalkonium chloride, benzenthonium chloride, pyridinium salt, imidazolinium salt, and the like. Commercially available products thereof are, for example, Surflon S-121 (manufactured by Asahi Glass Co., Ltd.), Fluorad FC-135 (manufactured by Sumitomo 3M Limited), UNIDAYNE DS-202 (manufactured by Daikin Industries, Ltd.), MEGAFACE F-150, F-824 (manufactured by Dainippon Ink and Chemicals Incorporated), and Ftergent F-300 (manufactured by Neos Co., Ltd.) and the like.

Further, water-insoluble inorganic compound can also be used as a dispersing agent. Examples of such compound are tricalcium phosphate, calcium carbonate, titanium oxide, colloidal silica, hydroxyapatite, and the like.

Yet, polymeric protecting colloid can be used to stabilize dispersion drops. Examples of the polymeric protecting colloid include acids such as acrylic acid, methacrylic acid, α-cyanoacrylic acid, itaconic acid, crotonic acid, fumaric acid, maleic acid, or the like; (meth)acrylic monomer having a hydroxyl group such as β-hydroxyethyl acrylic acid, β-hydroxyethyl methacrylic acid, β-hydroxypropyl acrylic acid, β-hydroxypropyl methacrylic acid, γ-hydroxypropyl acrylic acid, γ-hydroxypropyl methacrylic acid, 3-chloro 2-hydroxypropyl acrylic acid, 3-chloro 2-hydroxypropyl methacrylic acid, diethyleneglycol monoacrylic ester, diethyleneglycol monomethacrylic ester, glycerin monoacrylic ester, glycerin monomethacrylic ester, N-methylolacrylamide, N-methylolmethacrylamide, and the like; vinyl alcohol or ethers with vinyl alcohol such as vinylmethylether, vinylethylether, vinylpropylether, or the like; esters of a compounf having vinyl alcohol and a carboxyl group such as vinyl acetate, vinyl propionate, vinyl lactate, or the like; acrylamide, methacrylamide, diacetoneacrylamide, and methylol compounds thereof; acid chlorides such as acryl chloride, methacryl chloride, or the like; homopolymers or co-polymers having a nitrogen atom or its heterocyclic ring, such as vinyl pyridine, vinyl pyrolidone, vinyl imidazole, ethylene imine, or the like; polyoxyethylenes such as polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene nonylphenylester, or the like; celluloses such as methyl cellulose, hydroxymethyl cellulose, hydroxypropyl cellulose, or the like.

In order to remove the organic solvent from the obtained emulsified dispersion, the whole part thereof can be gradually heated so as to completely evaporate the organic solvent therein. It is also possible to remove the organic solvent by spraying the emulsified dispersion into a dry atmosphere. In this case, the aqueous dispersing agent can also be evaporated and removed together with the organic solvent. Examples of the dry atmosphere are heated gases such as air, nitrogen, carbon dioxide, combustion gas, or the like. Especially, it is preferable to use draft of the above-mentioned gases which is heated at higher temperature than the highest boiling point of the used solvents. A targeting quality is efficiently attained with a high-speed treatment such as using a spray dryer, belt dryer, rotary kiln, or the like.

In the case that acid or alkali soluble dispersing stabilizer is used such as calcium phosphate or the like, acid such as hydrochloric acid or the like is applied for dissolving calcium phosphate or the like, and thereafter the particles are subjected to rinse with water so as to remove calcium phosphate or the like from the particles. Further, enzymes or the like may also be used to decompose the dispersing stabilizer so as to remove the dispersing stabilizer from the particles.

In the case that the dispersing agent is added, the dispersing agent can be left on a surface of toner particles, but it is preferred to wash it out after the completion of elongation and/or cross-linking reaction, from the viewpoint of charging ability of a toner.

A solvent, which can dissolve the urea-modified polyester (u) or the pre-polymer, can also be added in order to lower the viscosity of the toner composition. It is preferred to use the solvent in terms of sharp particle diameter distribution. Moreover, the solvent preferably has a boiling point of less than 100° C. and exhibits volatility, from the viewpoint of ease of elimination. Examples of the solvent are toluene, xylene, benzene, carbon tetrachloride, methylene chloride, chloroform, monochlorobenzene, dichloroethylidene, methyl acetate, ethyl acetate, methylethylketone, methylisobutylketone, and the like. These may be used singly or in combination of two or more. Of these, particularly preferable solvents are aromatic solvents such as toluene, xylene, or the like, and halogenated hydrocarbons such as methylene chloride, 1,2-duchloroethane, chloroform, carbon tetrachloride, or the like. The usage amount of the solvent is generally 0 to about 300 parts by weight, preferably 0 to 100 parts by weight, and more preferably 25 parts by weight to 70 parts by weight, relative to 100 parts by weight of the pre-polymer (A). In order to remove the solvent, the solvent is heated under normal pressure or reduced pressure after the completion of elongation and/or cross-linking reaction.

The reaction time of elongation and/or cross-linking reaction is adjusted depending on the reactivity of the combination of an isocyanate group structure within the prepolymer (A) and amines. The reaction time is generally about 10 minutes to about 40 hours, and preferably 2 to 24 hours. The reaction temperature is generally about 0° C. to about 150° C., and preferably 40° C. to 98° C. Additionally, known catalysts may be added, if required. Examples of the catalyst are dibutyltin laurate, dioctyltin laulate, and the like.

If the particle diameter distribution is wide at the time of emulsified dispersion and also at the time of washing and drying, the particles are graded so as to attain the targeting particle diameter distribution.

The grading of particles can be carried out in the solution using a cyclone, decanter, centrifugal or the like so as to attain the predetermined particle diameter distribution. Although the grading can be carried out on dried particles after drying, it is more preferred if the grading is carried out in a solution, from the viewpoint of efficiency of the process. The obtained irregular toner particles and coarse particles, as a result of the grading, are sent back to the kneading step so as to recycle. In this case, the coarse particles may be in a wet condition.

The dispersing agent is preferably removed from the obtained dispersion, and more preferably removed at the same time of the grading.

The obtained dried toner particles are mixed with other particles such as mold-releasing agent particles, charge-controlling particles, superplasticizer particles, colorant particles and the like. Thereafter, mechanical impact force is applied to the mixed particles so as to fix or fuse the particles on the surface of the toner particle. In this way, the obtained complex toner particle can prevent falling of other particles therefrom.

Specific methods for applying an impact force are, for example, the method in which the impact force is applied to the mixed particles by using the rotated inpeller blade in high speed, the method in which placing the mixed particles in high-speed flow so as to subject the mixed particles or complex particles to be in a collision course with a suitable collision boad. Examples of the apparatus therefor include angmill (manufactured by Hosokawa Micron Corporation), the modified I-type mill (manufactured by Nippon Pneumatic MFG, Co., Ltd) which is reduced pulverizing air pressure, hybridization system (manufactured by Nara Machine Corporation), Kryptron System (manufactured by Kawasaki Heavy Industries, Ltd.), automatic mortar, and the like.

The volume average particle diameter (Dv) of the toner of the present invention is about 3 μm to about 8 μm, and the ratio (Dv/Dn) of number average particle diameter (Dn) to the volume average particle diameter (Dv) is about 1.00 to about 1.20. It is preferred that the volume average particle diameter (Dv) is 3 μm to 6 μm and the ratio (Dv/Dn) is 1.00 to 1.15, from the viewpoints of excellent heat resistant storability, low temperature fixing ability, and hot offset resistance. By satisfying the above-mentioned preferred ranges, especially glossiness of an image becomes excellent in the case that the toner is used in a full-color copier.

Further, in the case that the toner is used as a double-component developer, variation of the toner particle diameter is minimized even after repeating the cycle of consumption and addition of the toner with respect to carrier at numerous times. As the toner keeps a narrow average particle diameter without being affected from stirring by the image developer for a long period, stable and excellent developing ability can be obtained. In the case that the toner is used as a single-component developer, furthermore, not only minimizing the variation of the toner particle diameter as with the double-component developer, but filming of the toner to a developing roller, and toner fusion of members such as toner blade which controls the toner thickness on the developing roller or the like, are also prevented. Hence, even if the toner is used (stirred) in the image developer for a long period of time, stable and excellent developing ability and images can be obtained.

It is generally known that the smaller a toner diameter can obtain the higher an image resolution and image quality. However, the toner having smaller toner diameter has a defect in transferring ability and cleaning ability. When a volume average particle of the toner is smaller than the range of the present invention, in the case of a double-component developer, the toner prone to fuse onto a surface of carrier by being stirred in the image developer for a long period of time and thus charging ability of the carrier is impaired. In addition, in the case of a single-component developer, filming of the toner to a developing roller, and toner fusion to members such as a blade which control the toner thickness on a developing roller or the like, prone to occur.

Theses tendencies are largely related to a content of fine particles. If a toner contains toner particles having a diameter of 3 μn or less at more than 10% by number relative to the total number thereof on the cross-section, the toner is more likely to fuse onto the carrier. Therefore, problems occur when stability of charge is highly required.

When a volume average particle diameter of toner is larger than the range of the present invention, on the other hand, not only being hard to obtain an image of high resolution and high quality, but also variation of the toner particle diameter becomes large since the toner is repeatedly consumed and supplied to adjust the toner amount with respect to the carrier in the image developer during developing.

Moreover, when the toner particle diameter is smaller than 3 μm, the toner may be floated in the air and the floated toner particles may harm human bodies. When the toner particle diameter is larger than 8 μm, sharpness of toner image on a photoconductor is decreased hence an image resolution is decreased.

Generally, an average particle diameter, and a particle distribution of a toner are measured by coulter counter method. The coulter counter method can be carried out with, for example, Coulter Counter TA-II, Coulter Multisizer II (the manufacturer: Beckman Coulter, Inc.) or the like. In the present invention, an average particle diameter, and a particle diameter distribution of a toner is measured by using the Coulter Counter TA-II connected with a personal computer PC 9801 (the manufacturer: NEC Corporation) in which Inter Face (the manufacturer: Institute of Japanese Union of Scientists & Engineers) is installed. Inter Face is a soft ware capable of analyzing and outputting number distribution and volume distribution of a toner.

The circularity of the toner of the present invention is measured with flow-type particle image analyzer FPIA-2000 (the manufacturer: Sysmex Corporation).

The circularity of the toner of the present invention is generally in a range of about 0.93 to about 1.00. It is very important for the toner of the present invention to have a certain shape and a certain distribution of the shape. When an average circularity of the toner is less than about 0.93, namely the irregularly shaped toner being far from a round shape, sufficient transfer ability, high quality images without scattering of the toner cannot be obtained. The irregularly shaped toner has stronger attraction forces, i.e., van der Waals force, image force, to smooth mediums such as a photoconductor than relatively spherical particles because this toner has more concave portions that are contact points to other mediums, and currents tends to be gathered and stay in the concave portions. In electrostatic transferring step, therefore, irregularly formed toner particles are selectively transferred within the toner which contains irregularly formed toner particles and spherical toner particles, as a result an image missing on character or line portions is occurred.

There are also problems in that the remained toner on the photoconductor has to be removed, a cleaner needs to be equipped therefor, and a toner yield (a usage ratio of the toner for image formation) is low. A circularity of pulverized toner is generally 0.910 to 0.920. Specific measuring method of circularity will be explained later.

In the case that the toner of the present invention is used as a double-component developer, the toner is mixed with magnetic carrier. The toner content of the double-component developer is 1 part by weight to 10 parts by weight relative to 100 parts by weight of the magnetic carrier. The magnetic carrier can be selected from any known carriers in the art such as iron particles, magnetite particles, or magnetic resin carrier, having a particle diameter of 20 μm to 200 μm. Coating materials of the magnetic carrier are, for example, amino resins such as urea-formaldehyde resin, melamine resin, benzoguanamine resin, urea resin, polyamide resin, epoxy resin and the like. Another examples are polyvinyl or polyvinylidene resins such as acrylic resin, polymethylmethacrylate, polyacrylonitrile, polyvinyl acetate, polyvinyl alcohol, polyvinylbutyral, or the like; polystyrene resins such as polystyrene, styrene-acryl copolymer, or the like; halogenated olefin resins such as polyvinyl chloride or the like; polyester resins such as polyethyleneterephthalate, polybutyleneterephtalate, or the like; polycarbonate resins, polyethylene resins, polyvinyl fluoride resins, polyvinylidene fluoride resins, polytrifluoroethylene resins polyhexafluoropropyrene resins, copolymers of vinylidene fluoride and acryl monomer, copolymers of vinylidene fluoride and vinyl fluoride, fluoro terpolymers such as terpolymer of tetrafluoroethylene, vinylidene fluoride, and non-fluoride monomer, silicone resins and the like. Further, electroconductive particles or the like may be added, if required. Examples of the electroconductive particles are metal particles, carbon black, titanium oxide, tin oxide, zinc oxide or the like. The electroconductive particles used in the present invention preferably have an average particle diameter of 1 μm or less. If the electroconductive particles have an average particle diameter of more than 1 μm, it is hard to control an electric resistance.

The toner of the present invention can also suitably used as a single-component magnetic toner or non-magnetic toner.

The suitable embodiment of the toner of the present invention will be described hereinafter.

The toner of the present invention suitably has a shape of spindle.

Following problems occur when the shape of the toner is irregular or compressed and the toner has poor particle fluidity because of its shape. The first problem is unsuitable toner deposition on background of the image or the like, as a result of insufficient friction charge. Another problem is that it is difficult for such badly shaped toner to precisely and uniformly be placed on very fine latent dot images at developing step. Therefore, such toner generally has poor dot reproducibility. Further, there is a problem in transfer efficiency in latent electrostatic transferring system since the irregularly shaped toner is hard to receive electric line of force.

In the case that a shape of toner is closest to the sphere, a particle fluidity of the toner is overly increased hence the toner excessively reacts with external forces. Consequently, the problem arises in that the toner particles are easily scattered from latent dot images during developing and transferring. Moreover, cleaning failures are more likely to occur since the sphere shaped toner is easily rolled out into the space between a photoconductor and a cleaning member.

As the toner of present invention has spindle shaped particles, particle fluidity is adequately controlled. Therefore friction charge is sufficiently performed on the toner and thus very fine dots can be accurately and uniformly developed without a toner deposition, thereafter the developed toner dot images are efficiently transferred. Consequently, the toner present invention has excellent dot reproducibility. Further, the toner of the present invention is suitably adjusted its particle fluidity so that scattering of the toner is efficiently prevented. The spindle shaped toner particle has limited rolling axes compared with the spherical toner particle so that cleaning failures such that the toner is rolled down under the cleaning member or the like, is inhibited.

Figure 1B:
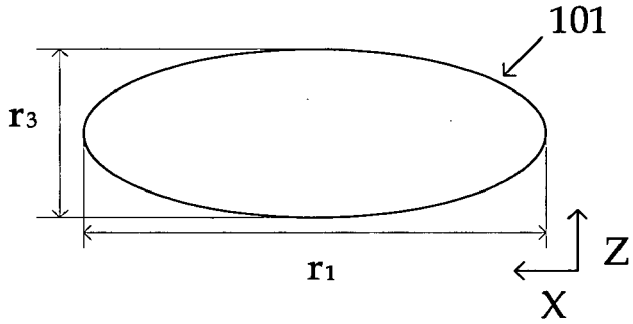

As shown in FIGS. 1A and 1B, the toner "101" of the present invention is preferably in a spindle shape in which the ratio (r2/r1) of a main axe r1 to a minor axe r2 is about 0.5 to about 0.8, and the ratio (r3/r2) of a thickness r3 to the minor axe r2 is about 0.7 to about 1.0. In addition, as shown a schematic cross-sectional view in FIG. 1C, the toner "101" of the present invention has a larger existing amount of wax in a surface portion thereof than a centric portion thereof. The dispersed wax particles "102" are existed more in the surface portion than in the centric portion. Here, "103" shows an inner circumference which has a two-third radius of the circumference of the toner particle.

When the ratio (r2/r1) is less than about 0.5, a cleaning property of the toner is high because of less spherical toner particle shape. However, it is insufficient in dot reproducibility and transfer efficiency hence high quality images cannot be obtained.

When the ratio (r2/r1) is more than about 0.8, cleaning failures tend to occur specially in an atmosphere of low temperature and low humidity since the toner particle shape become closer to sphere.

Moreover, when the ratio (r3/r2) is less than about 0.7, the toner has almost compressed particle shape so that high transfer efficiency as the spherical toner cannot be obtained even though scattering of the toner is inhibited likewise the irregularly shaped toner. Especially when the ratio (r3/r2) is 1.0, a shape of the toner becomes almost rotator having the main axe as a rotating axe. By satisfying this numeric value, the toner has a particle shape other than an irregular shape, compressed shape, and sphere. This is the shape that can attain all of friction charging ability, dot reproducibility, transfer efficiency, scattering inhibition, and cleaning ability.

Figure 1C:
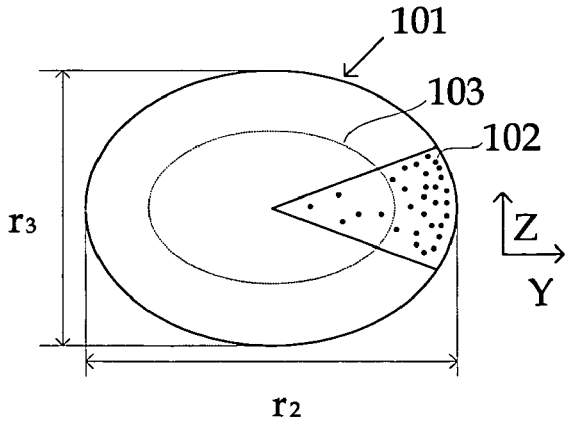

FIGS. 1A through 1C are diagrams which explains a main axe, a minor axe and a thickness of the toner of the present invention. The lengths showing with r1, r2 and r3 can be monitored and measured with scanning electron microscope (SEM) by taking pictures from different angles.

<Image-Forming Apparatus>

The image-forming apparatus of the present invention uses the toner of the present invention. In the present invention, "image developer" refers to a unit for developing a latent electrostatic image formed on a photoconductor using the toner of the present invention accommodated therein, "transfer" refers to a unit for transferring the developed toner image from the photoconductor to a recording medium, and "fixer" refers to a unit for fixing the transferred toner image on the recording medium. In the image-forming apparatus of the present invention, furthermore, the recording medium carrying the toner image thereon is passed through a pair of roller in the fixer so that the toner image is heated and fused and then fixed on the recording medium. The image-forming apparatus of the present invention is characterized in that fixing is carried out with bearing stress (roller load/contact area), which is applied to the pair of roller, of $1.5\times10^5$ Pa or less.

Figure 2:
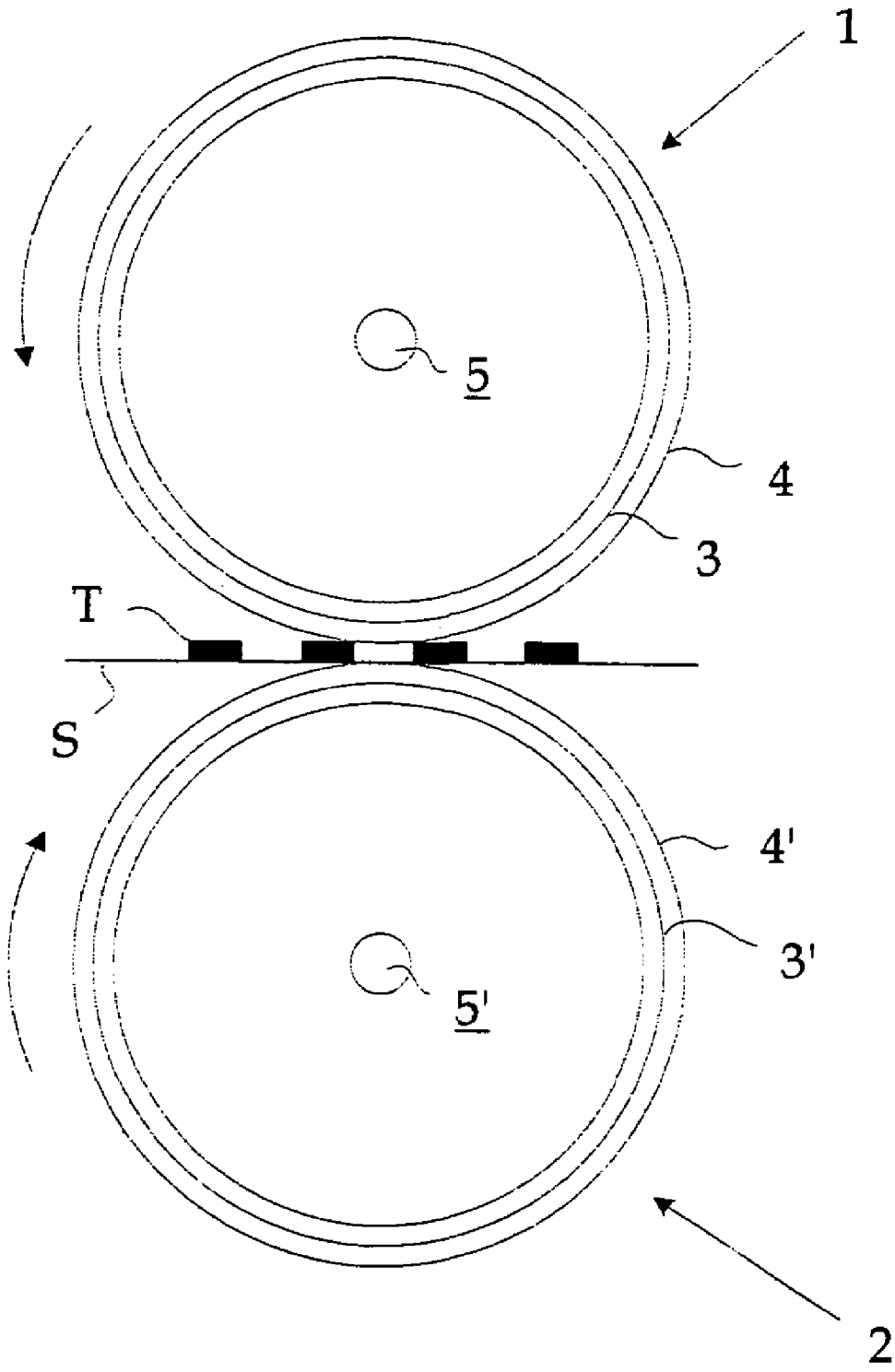
FIG. 2 is a schematic diagram showing an example of a fixer in the image-forming apparatus of the present invention.

An example of the fixer in the present invention is shown in FIG. 2. In FIG. 2, "1" shows a fixing roller, "2" shows a pressurizing roller, "3" shows a metal cylinder, "4" shows an offset inhibiting layer, "5" shows a heating lamp, "3'" shows a metal cylinder, "4'" shows an offset inhibiting layer, "5'" shows a heating lamp, "T" shows a toner image, and "S" shows a support (a recording medium such as a sheet of paper).

In the fixer which can be used in the image-forming apparatus of the present invention, fixing has not been performed with the bearing stress (roller load/contact area), which is applied to the pair of roller, of $1.5\times10^5$ Pa or less. Conventionally, bearing stress to the roller is more than $1.5\times10^5$ Pa, otherwise fixing becomes insufficient. On contrary, the toner of the present invention is capable of fixing at low temperature so that it is possible to perform fixing with the bearing stress of $1.5\times10^5$ Pa or less. By fixing with low bearing stress, a toner image is not be pushed onto the recording medium and thus highly defined image out-put is realized.

The image-forming apparatus is also characterized in that it comprises the toner of the present invention, and the following fixer. The fixer comprises a heating member which equips an exothermic body, a film which is in contact with the heating member, and a pressurizing member which in contact with the heating member via the film. In this fixer, a recording medium carrying an unfixed toner image is inserted between the film and the pressurizing member so as to heat and fix the toner image on the recording medium.

Figure 3:
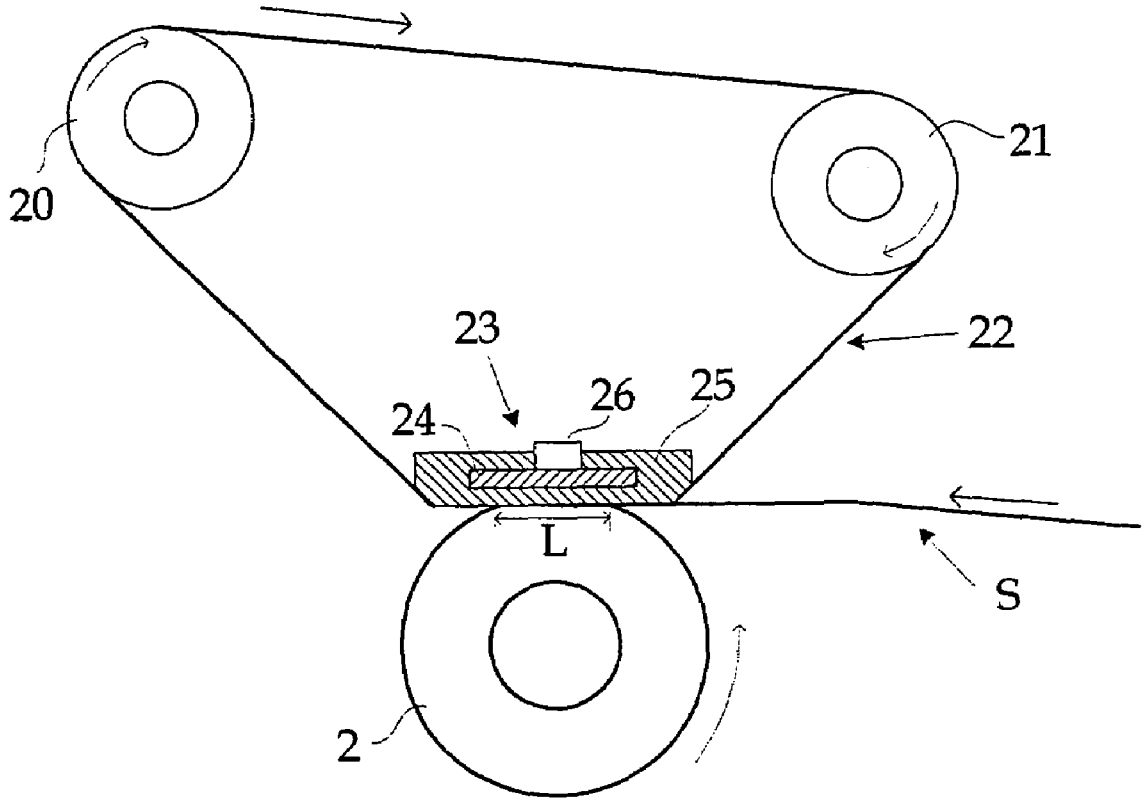
FIG. 3 is a schematic diagram showing an example of a fixer of the image-forming apparatus of the present invention.

The fixer used in the image-forming apparatus of the present invention is, as shown in FIG. 3, a SURF (surface rapid fusing) fixer in which fixing is carried out by rotating a fixing film "22". Specifically, the fixing film "22" is a heat resisting film in a form of an endless belt, and the fixing film is suspended around a driving roller "20" which is a supportive rotator of the fixing film "22", a driven roller "20" and a heating member "23" which is disposed downside and in between of the driving roller "20" and a driven roller "21", supported by a flat substrate "25".

The driven roller "21" also works as a tension roller of the fixing film "22". The fixing film "22" is driven in clockwise rotating direction as shown in the figure by the driving roller "21" so as to rotate in a clockwise direction. This rotating speed is controlled so to travel at the same speed as a transfer medium "S" at a nip region "L" at where the pressurizing roller "2" and the fixing film "22" are contacted to each other.

The pressurizing roller "2" has a rubber elastic layer having an excellent mold-releasing ability, such as silicone rubber or the like. The pressurizing roller "2" rotates in counterclockwise direction so as to adjust a contact pressure at 4 kg to 10 kg with respect to the fixing nip region "L".

The fixing film "22" preferably has excellent heat resistance, mold-releasing ability and wearing resistance. The thickness thereof is generally 100 μm or less, and preferably 40 μm. Examples of the fixing film are single or multi layered film of heat resistant resins such as polyimide, polyether imide, PES (polyether sulfide), PFA (tetrafluoroethylene-perfluoroalkylvinylether copolymer) and the like. Specific examples may be a film having a thickness of 20 μm in which a releasing coat layer of 10 μm thickness, formed of electroconducting agent added fluoride resin such as PTFE (polytetrafluoroethylene resin), PFA, or an elastic layer such as fluoro rubber, silicone rubber or the like is disposed on the side contacting with an image.

In FIG. 3, the heating member "23" contains the flat substrate "25" and a fixing heater "24". The flat substrate "25" is formed of a material having high thermal conductivity and high electric resistance, such as alumina or the like. On the surface of the heating member "23" where the fixing film "22" is in a contact with, the fixing heater "24" formed of resistant exothermic body is disposed so that the longer side of the fixing heater "24" is lied along the traveling direction of the fixing film "22". Such fixing heater "24" is, for example, screen printed with electric resistant material such as Ag/Pd, $Ta_2N$, or the like in liner stripe or band stripe. Moreover, two electrodes (not shown in FIG. 3) are disposed at both ends of fixing heater "24" so that the resistant exothermic body generates a heat by energizing between the electrodes. Further, on a side of the flat substrate "25" opposite to the fixing heater "24", a fixing thermal sensor "26" formed of thermistor is disposed.

Thermal information of the flat substrate "25" is detected by the fixing thermal sensor "26" and is sent to a controller so that quantity of electricity, which is applied to the fixing heater "24", is controlled and thus the heating member "23" is controlled at a certain temperature.

The process cartridge of the present invention comprises the toner of the present invention, and a photoconductor. The process cartridge of the present invention may further comprise a charger, an image developer, and a cleaner. The process cartridge is replaceable from the image-forming apparatus.

Figure 4:
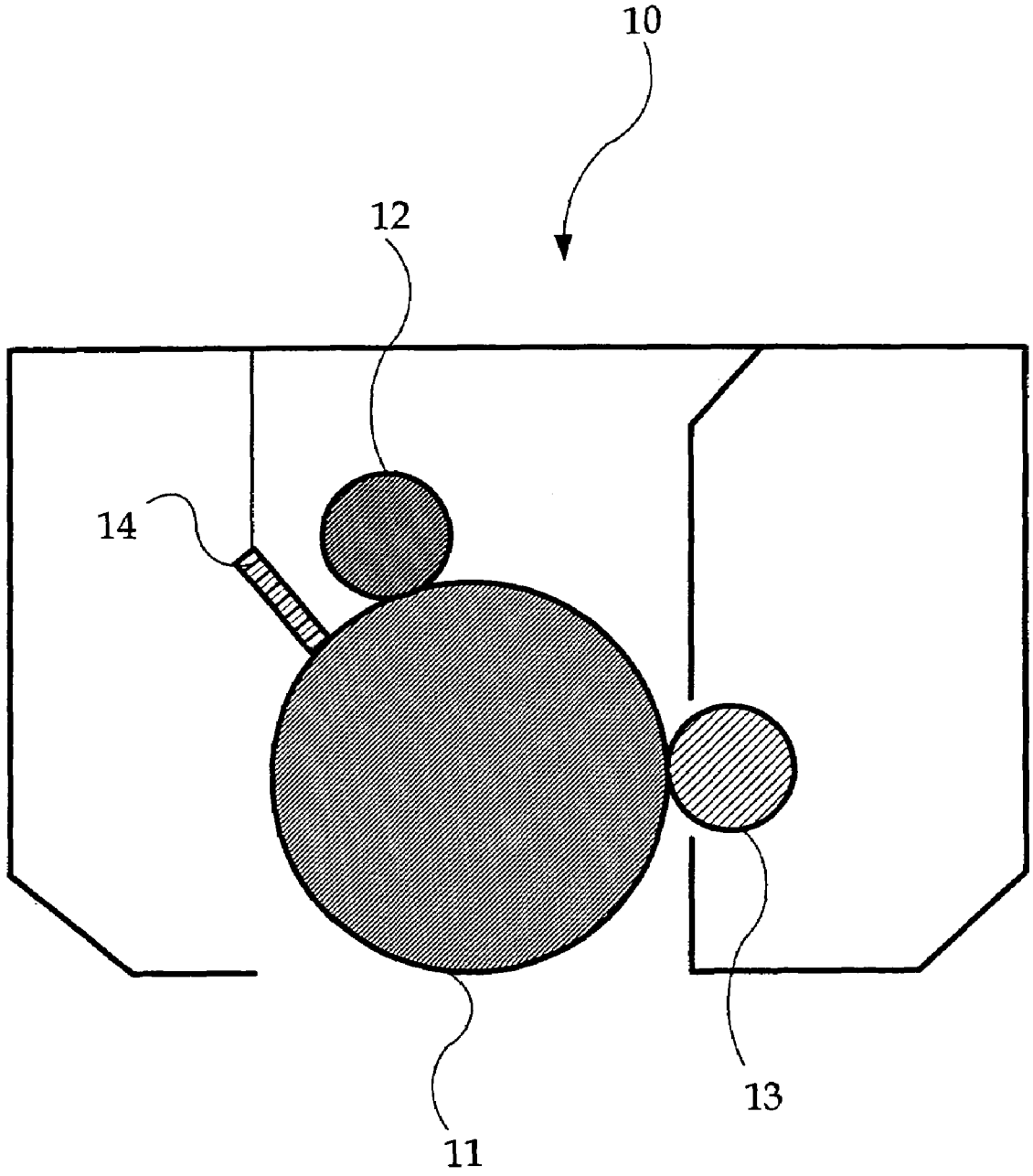
FIG. 4 is a schematic diagram showing an example of an image-forming apparatus having the process cartridge of the present invention.

FIG. 4 shows an example of a schematic structure of an image-forming apparatus which equips the process cartridge of the present invention.

In FIG. 4, "10" shows the process cartridge, "11" shows a photoconductor, "12" shows a charger, "13" shows an image developer, and "14" shows a cleaner.

In the present invention, at least one of the charger "12", the image developer "13", and the cleaner "14" are connected to the photoconductor "11" so as to form the process cartridge "10". Moreover this process cartridge is designed so as to replaceable to an image-forming apparatus such as copier, printer or the like.

In the image-forming apparatus which equips the process cartridge of the present invention, the photoconductor is rotated at predetermined peripheral velocity. During the cycle of a rotation of the photoconductor, the charger uniformly charges the photoconductor at predetermined positive or negative potential, thereafter a light irradiator such as slit exposure or laser beam scanning exposure, irradiates light imagewisely to the charged photoconductor. In this way, latent electrostatic images are sequentially formed on the circumference surface of the photoconductor. As follow, the image developer develops the formed latent electrostatic image with the toner so as to form a toner image, and then the transfer sequentially transfer the toner image onto a transfer medium which is fed from a paper feeder to between the photoconductor and the transfer at the same timing to the rotation of the photoconductor. The transfer medium bearing the transferred toner image is separated from the photoconductor, and is introduced to the fixer. The fixer fixes the transferred image onto the transfer medium so as to form a reproduction (copy) and then the copy is sent out from the apparatus, i.e., printed out. After transferring the toner image, cleaner removes the remained toner onto the surface of the photoconductor so as to clean the surface. Thereafter, the photoconductor is destaticized so as to be ready for the following image formation.

The image-forming apparatus of the present invention is characterized in that the photoconductor that is used for image-formation is an amorphous silicon photoconductor.

(Amorphous Silicon Photoconductor)

In the present invention, an amorphous silicon photoconductor is used as a photoconductor for electrophotography. The amorphous silicon photoconductor (refer to "a-Si photoconductor" hereinafter) has a substrate and a photoconductive layer formed of a-Si. The photoconductive layer is formed on the substrate by a film forming method such as vacuum deposition, spattering, ion-plating, thermal CVD, optical CVD, plasma CVD, or the like. Of these, preferable method is plasma CVD in which raw material gas is decomposed by glow discharge of direct current, high frequency, or microwave, and then a-Si is deposited on the substrate so as to form an a-Si film.

(Layer Structure)

Figure 5:
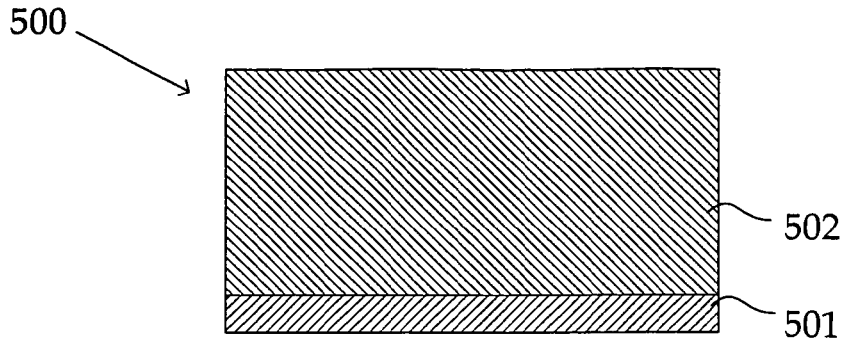
FIG. 5 is a cross-sectional view explaining a layer structure of an example of a photoconductor disposed in the image-forming apparatus of the present invention.
Figure 6:
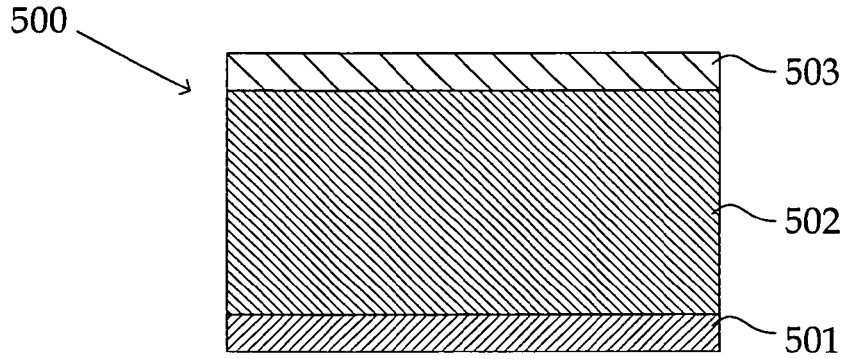
FIG. 6 is a cross-sectional view explaining a layer structure of another example of a photoconductor disposed in the image-forming apparatus of the present invention.
Figure 7:
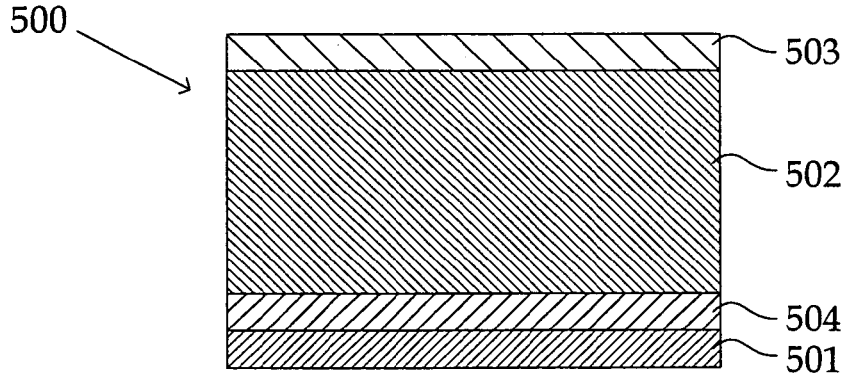
FIG. 7 is a cross-sectional view explaining a layer structure of another example of a photoconductor disposed in the image-forming apparatus of the present invention.
Figure 8:
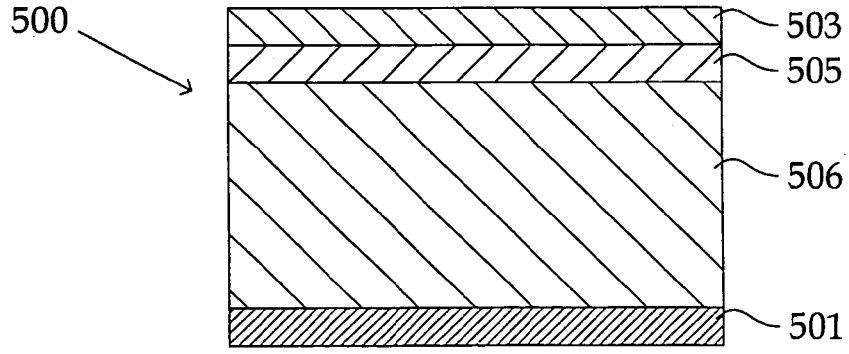
FIG. 8 is a cross-sectional view explaining a layer structure of another example of a photoconductor disposed in the image-forming apparatus of the present invention.

The amorphous silicon photoconductor has a layer structure of as follow. FIGS. 5 through 8 are schematic diagrams which explain the layer structure of the amorphous silicon photoconductor. In FIG. 5, a photoconductor for electrophotography "500" has a substrate "501" and a photoconductive layer "502" on the substrate "501". The photoconductive layer "502" is formed of a-Si: H, X, and exhibits photoconductivity. In FIG. 6, a photoconductor for electrophotography "500" has a substrate "501", and the substrate "501", a photoconductive layer "502" formed of a-Si: H, X and an amorphous silicon surface layer "503". In FIG. 7, a photoconductor for electrophotography "500" has a substrate "501", and the substrate "501", a photoconductive layer "502" formed of a-Si: H, X, an amorphous silicon surface layer "503" and an amorphous silicon charge injection inhibiting layer "504". In FIG. 8, a photoconductor for electrophotography "500" has a substrate "501" and a photoconductive layer "502" on the substrate "501". The photoconductive layer "502" consists of a current generating layer formed of a-Si: H, X "505" and a current transporting layer "506". The photoconductor for electrophotography "500" further has an amorphous silicon surface layer "503" on the photoconductive layer "502".

(Substrate)

The substrate of the photoconductor may be conductivity or isolating. Examples of the conductive substrate include metals such as Al, Cr, Mo, Au, In, Nb, Te, V, Ti, Pt, Pd, Fe and the like, and alloys thereof such as styrene and the like. Also, it can be use as a substrate that an insolating substrate such as a film or sheet of synthetic resin, e.g., polyester, polyethylene, polycarbonate, cellulose acetate, polypropylene, polyvinyl chloride, polystyrene, polyamide, or the like, glass, ceramic, in which at least a surface where faces to a photoconductive layer is treated to yield conductivity.

The shape of the substrate may be cylindrical, plate, or endless belt, which has a smooth or irregular surface. The thickness of thereof can be adjusted so as to form a predetermined photoconductor. In the case that flexibility is required to the photoconductor, the substrate can be as thinner as possible, provided that efficiently functioning as a substrate. The thickness of the substrate is generally 10 μm or more from the viewpoints of manufacture, handling, mechanical strength, and the like.

(Current Injection Inhibiting Layer)

In the photoconductor used in the present invention, it is effective to dispose a current injection inhibiting layer, which inhibits a current injection from a conductive substrate, between the conductive substrate and the photoconductive layer (refer to FIG. 7). The current injection inhibiting layer has a polarity dependency. Namely, when charging of single polarity is applied to a free surface of the photoconductor, the current injection inhibiting layer functions so as to inhibit a current injection from the conductive substrate to the photoconductive layer, and when charging of opposite polarity is applied, the current injection inhibiting layer does not function. In order to attain such function, the current injection inhibiting layer has relatively a lot of atoms which control a conductivity, compared with the photoconductive layer.

The thickness of the photoconductive layer is preferably about 0.1 μm to about 5 μm, more preferably 0.3 μm to 4 μm, and furthermore preferable 0.5 μm to 3 μm.

(Photoconductive Layer)

The photoconductive layer is disposed above the substrate. The thickness of the photoconductive layer is not particularly limited, provided that obtaining a predetermined electrophotographic property and cost efficiency. The thickness thereof is preferably about 1 μm to about 100 μm, more preferably 20 μm to 50 μm, and furthermore preferably 23 μm to 45 μm.

(Current Transporting Layer)

The current transporting layer is, in the case that the photoconductive layer is divided by its functions, a layer which mainly functions to transport currents. The current transporting layer contains at least a silicon atom, a carbon atom, and a fluoride atom as its essential component. If needed, the current transporting layer further contains a hydrogen atom and an oxygen atom so that the current transporting layer is formed of a-SiC(H,F,O). Such current transporting layer exhibits desirable photoconductivity, especially current holding property, current generating property, and current transporting property. It is particularly preferable that the current transporting layer contains an oxygen atom.

The thickness of the current transporting layer is suitably adjusted so as to obtain desirable electrophotographic property and cost efficiency. The thickness thereof is preferably about 5 μm to about 50 μm, more preferably 10 μm to 40 μm, and the most preferably 20 μm to 30 μm.

(Current Generating Layer)

The current generating layer is, in the case that the photoconductive layer is divided by its functions, a layer which mainly functions to generate currents. The current generating layer contains at least a silicon atom as an essential component and does not substantially contain a carbon atom. If needed, the current generating layer further contains a hydrogen atom so that the current generating layer is formed of a-Si:H. Such current generating layer exhibits desirable photoconductivity, especially current generating property and current transporting property.

The thickness of the current generating layer is suitably adjusted so as to obtain desirable electrophotographic property and cost efficiency. The thickness thereof is preferably about 0.5 μm to about 15 μm, more preferably 1 μm to 10 μm, and the most preferably 1 μm to 5 μm.

(Surface Layer)

The amorphous silicon photoconductor used in the present invention may further contain a surface layer disposed on the photoconductive layer which is formed on the substrate as mentioned above. It is preferred to contain an amorphous silicon surface layer. The surface layer has a free surface so that desirable properties such as moisture resistance, repeating property, electric pressure tightness, environmental capability, durability and the like.

The thickness of the surface layer is generally about 0.01 μm to about 3 μm, preferably 0.05 μm to 2 μm, and more preferably 0.1 μm to 1 μm. When the thickness thereof is less than about 0.01 μm, the surface layer is worn out during usage of the photoconductor. When the thickness thereof is more than about 3 μm, electrophotography property is impaired such as an increase of residual charge, and the like.

The image-forming apparatus of the present invention is characterized in that an alternating field is applied when a latent electrostatic image on the photoconductor is developed.

Figure 9:
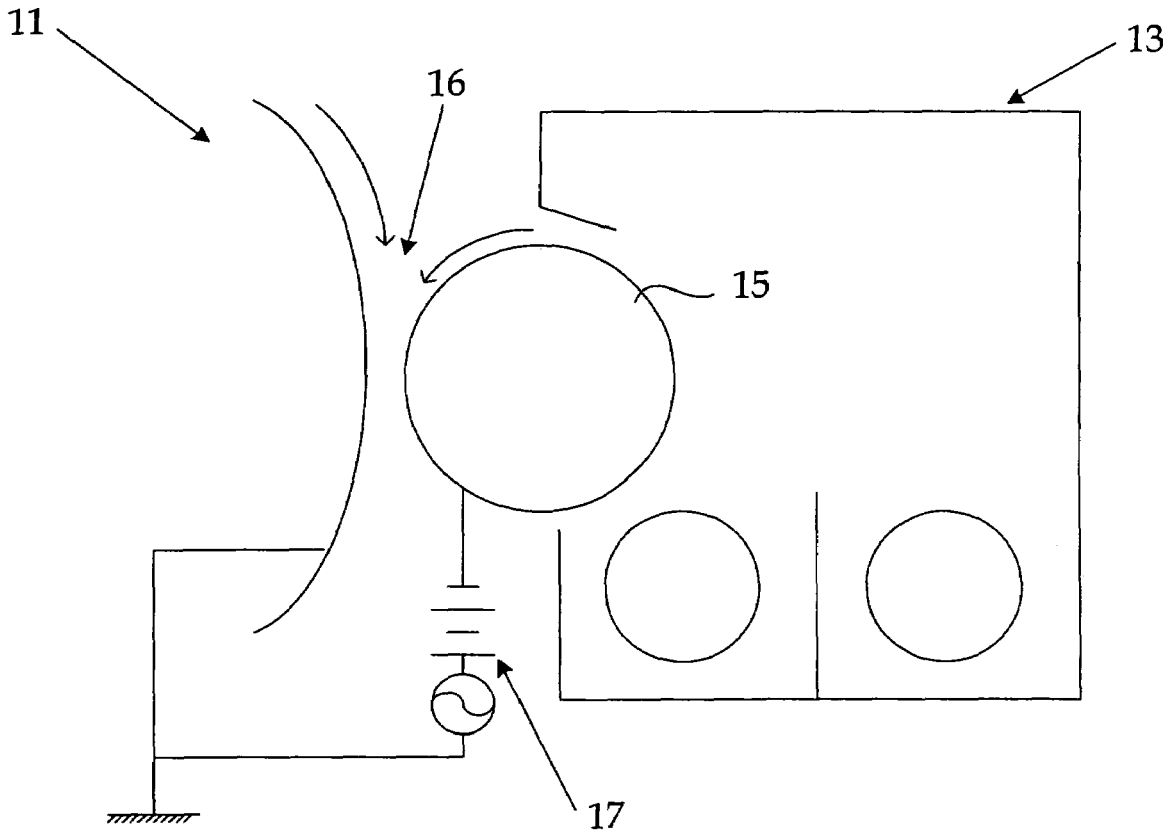
FIG. 9 is a schematic diagram showing an example of an image developer disposed in the image-forming apparatus of the present invention.

In an image developer "13" shown in FIG. 9, a power supply "17" applies vibration bias voltage as developing bias, in which voltage direct current and alternating voltage are superpositioned, to a developing sleeve "15" during developing. The potential of background part and the potential of image part are positioned between maximum value and minimum value of the vibration bias potential. This forms an alternating field in which directions alternately change at developing region "16". A toner and a carrier are intensively vibrated in this alternating field, so that the toner overshoots the electrostatic force of constraint from the developing sleeve "15" and the carrier, and leaps to the photoconductor "11". The toner is then attached to the photoconductor relative to a latent electrostatic image thereon.

The difference of maximum value and minimum value of the vibration bias voltage (peak range voltage) is preferably 0.5 KV to 5 KV, and the frequency is preferably 1 KHz to 10 KHz. The waveform of the vibration bias voltage may be a rectangle wave, a sine wave, or a triangle wave. The voltage direct current of the vibration bias voltage is in the range of the potential at the background and the potential at the image as mentioned above, and is preferable set closer to the potential at the background from viewpoints of inhibiting a toner deposition on the background.

In the case that the waveform of the vibration bias voltage is a rectangle wave, it is preferred that a duty ratio is 50% or less. Here, the duty ratio is a ratio of time when the toner leaps to the photoconductor during a cycle of the vibration bias. In this way, the difference between the peak time value when the toner leaps the photoconductor and the time average value of bias can become very large. Consequently, the movement of the toner becomes further activated hence the toner is accurately attached to the potential distribution of the latent electrostatic image and rough deposits and an image resolution can be improved. Moreover, the difference between the time peak value when the carrier, which has an opposite polarity of current to the toner, leaps to the photoconductor and the time average value of bias can be small. Consequently the movement of the carrier can be restrained and the possibility of the carrier deposition on the background is largely reduced.

Figure 10:
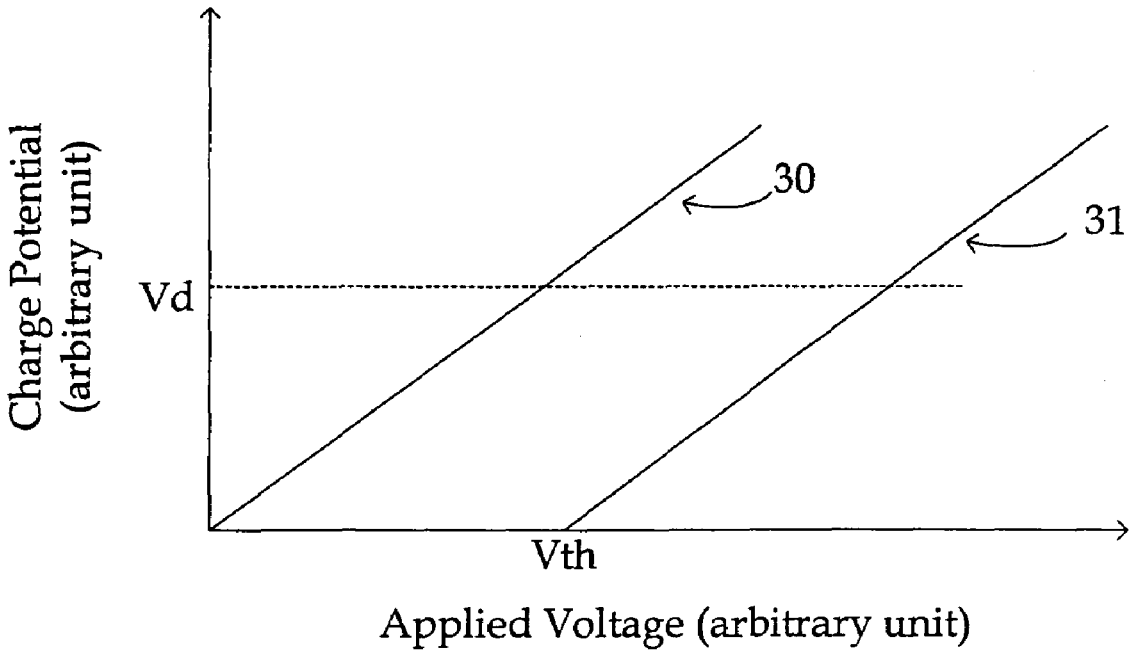
FIG. 10 is a diagram showing an example of a charging characteristic of a contact charger.

The image-forming apparatus of the present invention is characterized in the charger disposed therein. Any known charger in the art can of course be suitably used in the image-forming apparatus of the present invention, but a contact charger is preferably used. Such charger contains a charging member, and the charging member is contacted to the photoconductor and applied voltage so as to charge the photoconductor. As can be seen in the graph of FIG. 10, the photoconductor obtains a potential with proportion of the applied voltage on the contact charger "30". Unless a discharge charger "31" is charged with a predetermined voltage or higher, on the other hand, the photoconductor cannot obtain a potential.

(Roller Charger)

Figure 11:
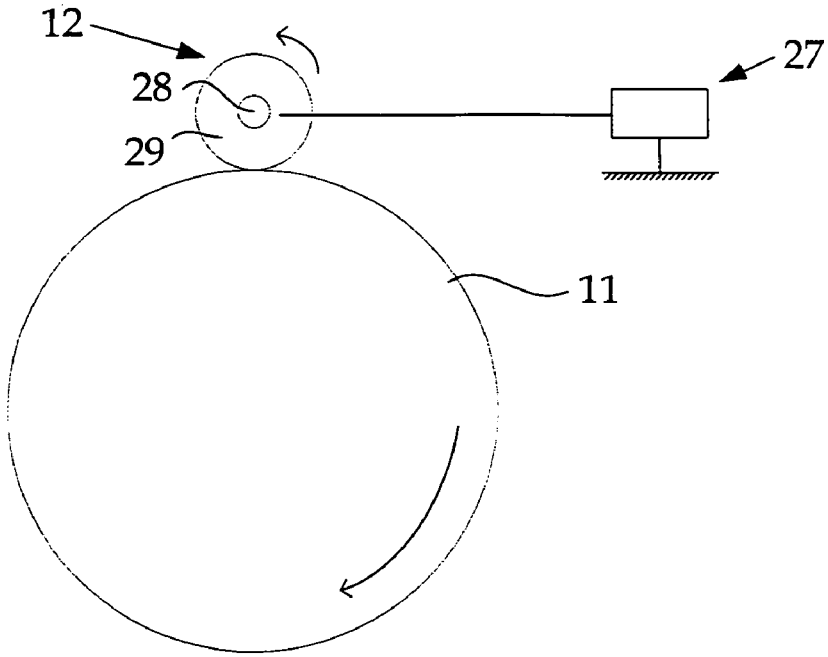
FIG. 11 is a diagram showing an example of a roller contact charger.

FIG. 11 is a schematic diagram of an example of the image-forming apparatus that equips a contact charger. The photoconductor "11" as an object to be charged and image bearing member, is rotated at a predetermined speed (process speed) in the direction shown with the arrow in the figure. The charging roller "12", which is subjected to be in contact with the photoconductor "11", contains a metal core and a conductive rubber layer formed on the metal core in a shape of a concentric circle. The both terminals of the metal core are supported with pillow blocks (not shown in FIG. 11) so that the charging roller enables to rotate freely, and the charging roller "12" is pressed to the photoconductor "11" at predetermined pressure by a pressurizing member (not shown in FIG. 11). The charging roller "12" in this figure therefore rotates along with the rotation of the photoconductor "11". The charging roller "12" is generally formed with a diameter of 16 mm in which a metal core "28" having a diameter of 9 mm is coated with a rubber layer "29" having a moderate resistance of approximately 100,000 Ω•cm.

The power supply "27" shown in the figure is electrically connected with the metal core "28", and a predetermined bias is applied to the metal core "28" by the power supply. In this way, the surface of the photoconductor is uniformly charged at a predetermined polarity and potential.

As a charger used in the present invention, an embodiment thereof is not particularly limited and the shaped of the charging member can be, apart from a roller, a magnetic brush, a fur brush or the like. It can be suitably selected according to a specification or embodiment of an image-forming apparatus. In the case that a magnetic brush is used as a charger, the magnetic brush contains a charging member formed of various ferrite particles such as Zn—Cu ferrite, a non-magnetic conductive sleeve to support the charging member, and a magnetic roller contained in the non-magnetic conductive sleeve. In the case that a fur brush is used as a charger, a material of the fur brush is, for example, a fur that is conductively treated with metals or metal oxides such as carbon, cupper sulfide, or the like, and the fur is coiled or mounted to a metal core which is formed of a metal or is conductively treated.

(Fur Brush Charger)

Figure 12:
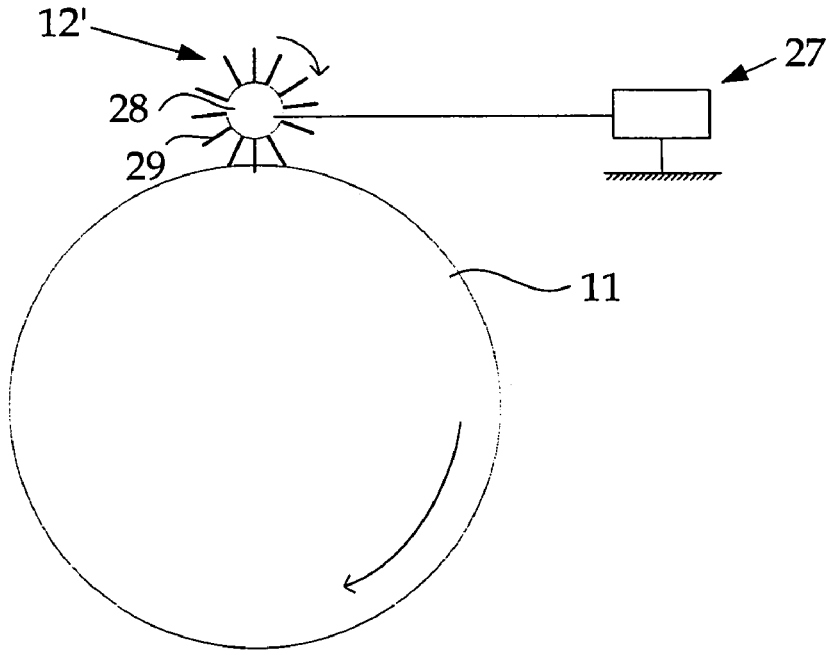
FIG. 12 is a diagram showing an example of a brush contact charger.

FIG. 12 is a schematic diagram of an example of the image-forming apparatus that equips a contact charger. The photoconductor "11" as an object to be charged and image bearing member, is rotated at a predetermined speed (process speed) in the direction shown with the arrow in the figure. The brush roller "12'''" having a fur brush is subjected to be in contact with the photoconductor "11", with a predetermined nip width and a predetermined pressure with respect to elasticity of the brush part.

The fur brush roller "12'''" as the contact charger used in the present invention, has an outside diameter of 14 mm, and a stretcher length of 250 mm. In this fur brush, a tape with a pile of conductive rayon fiber REC-B (the manufacturer: Unitika Ltd.), as a brush part "29", is spirally coiled around a metal core "28" having a diameter of 6 mm, which is also functioned as an electrode. The brush of the brush part "29" is 300 denier/50 filament, and a density of 151 fibers per 1 square millimeter. This role brush is once inserted into a pipe having an internal diameter of 12 mm with rotating in a certain direction, and is set so as to be a concentric circle relative to the pipe. Thereafter, this role brush in the pipe is left in an atmosphere of high humidity and high temperature so as to twist the fibers of the fur.

The resistance of the fur brush roller "12'''" is $1\times10^5$ Ω relative to the applied voltage of 100 V. This resistance is calculated from the current obtained when the fur brush rolled is contacted with a metal drum having a diameter of 30 mm with a nip width of 3 mm then a voltage of 100 V is applied thereon.

The resistance of the fur brush roller "12'''" needs to be $10^4$ Ω or more in order to prevent image imperfection caused by an insufficient charge at the charging nip part when the photoconductor "11" as an object to be charged happens to have a low pressure-resistance defects such as pin holes thereon and an excessive leak current therefore runs into the defects. Moreover, the resistance of the fur brush roller "12'''" needs to be $10^4$ Ω or less in order to sufficiently charge the surface of the photoconductor "11".

The material of the fur may suitably be other than REC-B (the manufacturer: Unitika Ltd.). Examples of the material include REC-C, REC-M1, REC-M10 (the manufacturer: Unitika Ltd.), SA-7 (the manufacturer: Toray Industries, Inc.), Thunderon (the manufacturer: Nihon Sanmo Dyeing Co., Ltd.), Beltron (the manufacturer: Kanebo Gohsen, Ltd.), Kuracarbo in which carbon is dispersed in rayon (the manufacture: Kuraray Co., Ltd.), Robal (the manufacture: Mitsubishi Rayon Co., Ltd.), and the like. The brush is, preferably 3 to 10 denier per fiber, 10 to 100 filaments per bundle, and 80 to 600 fibers per square millimeter. The length of the fur is preferably 1 to 10 mm.

The fur brush roller "12'''" is rotated in the opposite (counter) direction to the rotation direction of the photoconductor "11" at a predetermined peripheral velocity, and contacts with the photoconductor "11", with velocity deference. The power supply "27" applies a predetermined charging voltage to the fur brush roller "12'''" so that the surface of the photoconductor "11" is uniformly charged at a predetermined polarity and potential. In contact charge of the photoconductor "11" by the fur brush roller "12" of the present embodiment, direct injection charge is dominantly performed and the surface of the photoconductor "11" is charged at the substantially equal voltage to the applying charging voltage to the fur brush roller "12".

As a charger used in the present invention, an embodiment thereof is not particularly limited and it can be suitably selected according to a specification or embodiment of an image-forming apparatus.

(Magnetic Brush Charger)

FIG. 12 is a schematic diagram of an example of the image-forming apparatus that equips a contact charger. The photoconductor "11" as an object to be charged and image bearing member, is rotated at a predetermined speed (process speed) in the direction shown with the arrow in the figure. The brush roller "12'" having a magnetic brush is subjected to be in contact with the photoconductor "11", with a predetermined nip width and a predetermined pressure with respect to elasticity of the brush part.

The magnetic brush "29" as a contact charger of the present embodiment is formed of magnetic particles. In the magnetic particles, Z—Cu ferrite particles having an average particle diameter of 25 μm and Z—Cu ferrite particles having an average particle diameter of 10 μm are mixed in a ratio of 1/0.05 so as to form ferrite particles having peaks at each average particle diameter, and a total average particle diameter of 25 μm. The ferrite particles are coated with a resin layer having a moderate resistance so as to form the magnetic particles. The contact charger of this embodiment formed from the above-mentioned coated magnetic particles, a non-magnetic conductive sleeve "28" which supports the coated magnetic particles, and a magnet roller which is included in the non-magnetic conductive sleeve "28". The coated magnetic particles are disposed on the sleeve with the thickness of 1 mm so as to form a charging nip of 5 mm with the photoconductor "11". Moreover, the width between the non-magnetic conductive sleeve "28" and the photoconductor "11" is adjusted to approximately 500 μm. Further, the magnetic roller "12'" is rotated so as to subject the non-magnetic conductive sleeve "28" to rotate at twice in speed relative to the peripheral speed of the surface of the photoconductor "11", and in the opposite direction with the photoconductor "11". Therefore, the magnetic brush "29" is set to uniformly contact with the photoconductor "11".

As a charger used in the present invention, an embodiment thereof is not particularly limited and it can be suitably selected according to a specification or embodiment of an image-forming apparatus.

The present invention will further be explained with Examples hereinafter, but the present invention is not, of cause, limited therewith. In Examples, "part" and "parts" each refer to "part by weight" and "parts by weight".

EXAMPLE 1

(Synthesis of Resin)

724 parts of bisphenol A ethylene oxide bimolar adduct, 276 parts of isophthalic acid and 2 parts of dibutyl tin oxide were introduced into a reaction vessel equipped with a condenser, stirrer and nitrogen inlet tube, were reacted under normal pressure at 230° C. for 8 hours, were reacted again under a reduced pressure of 10 to 15 mmHg for 5 hours and cooled to 160° C., then 32 parts of phthalic anhydride was added and the reaction was continued for 2 hours. Next, the reaction mixture was cooled to 80° C., and 188 parts of isohorone diisocyanate was added in ethyl acetate and reacted for 2 hours to obtain a pre-polymer (A) containing isocyanate. Next, 267 parts of the pre-polymer (A) and 14 parts of isohorone diamine were reacted at 50° C. for 2 hours to obtain a urea-modified polyester resin (u) having a weight average molecular weight of 64,000. In an identical manner to that of the above, 724 parts of bisphenol A ethylene oxide bimolar adduct and 276 parts of isophthalic acid were condensation polymerized at 230° C. for 8 hours, and then reacted under a reduced pressure of 10 mmHg to 15 mmHg for 5 hours to obtain a non-modified polyester resin (a) having a peak molecular weight of 5,000. 200 parts of the urea-modified polyester resin (1) and 800 parts of the non-modified polyester resin (a) were dissolved in 2,000 parts of ethyl acetate/MEK (1/1) mixed solvent, and stirred to obtain an ethyl acetate/MEK solution of the resin (1). This was dried under partial reduced pressure to isolate the resin (1). Tg was 62° C., an acid value was 4.2 KOHmg/g, and a peak molecular weight was 4,500.

(Preparation of Toner)

240 parts of an ethyl acetate/MEK solution of the resin (1), 5 parts of ester wax as wax (acid value: 3) and 8 parts of carbon black (BP1300, the manufacturer: Cabot Corporation) were introduced into a beaker, and stirred at 12,000 rpm at 60° C. by a TK homomixer to uniformly dissolve and disperse the ingredients. 706 parts of ion exchange water, 294 parts of a 10% suspension of hydroxyapatite (Supertite 10, the manufacture: Japan Chemical Industries) and 0.2 parts of a sodium dodceyl benzene sulfonate were introduced into the beaker, and uniformly dissolved. Next, the temperature was raised to 60° C., and the above toner material solution was introduced while stirring at 12,000 rpm in the TK homomixer for 10 minutes, and thereafter was left to stand for 2 hours to stabilize. Next, this mixed solution was transferred to a flask equipped with a stirring rod and thermometer, the temperature was raised to 98° C. to remove the solvent. Subsequently, the product was filtered, rinsed and dried, and graded by air power to obtain toner particles. The volume average particle diameter was 6.3 μm (volume average particle diameter [Dv]/number average particle diameter [Dn]: 1.14), and the circularity was 0.97. Next, 0.5 parts of hydrophobic silica was added to 100 parts of the toner particles and mixed in a Henschel mixer to obtain the toner (1) of the present invention.

The obtained toner was observed under a transmission electron microscope (TEM). In this toner, the occupied area ratio of the wax in a region on an arbitrary cross-section of the toner particle having a center of the toner particle thereon was 20%. Here, the region is positioned between a circumference of the toner particle and an inner circumference having a radius which is two-third of a radius of the circumference. Moreover, the wax was not existed on the surface of the toner particle, the existing amount of the wax in the surface portion of the toner particle was 86% by number, and dispersed wax particles having a diameter of 0.1 μm to 3.0 μm were 88% by number.

(Measuring Method)

1. Particle Diameter Distribution

At first, a dispersant, i.e., 0.1 ml to 5 ml of surfactant (preferably alkylbenzene sulfonate) was added to 100 ml to 150 ml of electrolytic solution. Here, the electrolytic solution was approximately 1% NaCl solution of primary sodium chloride, for example, ISOTON-IL (the manufacturer: Beckman Coulter, Inc.). Next, 2 mg to 20 mg of test portion was added to the electrolytic solution. The electrolytic solution suspending the test portion was dispersed by an ultrasonic disperser for about 1 minute to 3 minutes. Thereafter, toner particles, or volume, number of toner were measured by the above-mentioned apparatus, i.e., the Coulter Counter TA-II (the manufacturer: Beckman Coulter, Inc.) connected to a personal computer PC 9801 (the manufacturer: NEC Corporation) and Inter Face (the manufacturer: Institute of Japanese Union of Scientists & Engineers), with an aperture of 100 μm, and volume particle distribution and number particle distribution were calculated thereby.

As channels, 13 channels of 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 12.70 μm; 12.70 μm to less than 16.00 μm; 16.00 μm to less than 20.20 μm; 20.20 μm to less than 25.40 μm; 25.40 μm to less than 32.00 μm; and 32.00 μm to less than 40.30 μm, were used. Here, the object was particles having a diameter range of 2.00 μm to less than 40.30 μm. Volume average particle diameter (Dv) of volume reference was calculated from the volume particle distribution, number average particle diameter (Dn) was calculated from the number particle distribution, and then a ratio Dv/Dn was calculated therefrom.

2. Circularity

The optical detection band method was used, wherein the particle-containing suspension was passed through a photographic detection band on a plate, and the particle images were optically detected/analyzed with a CCD camera.

This value can be measured as the circularity on average by a flow type particle image analyzer FPIA-2000 (the manufacturer: To a Medical Electronics). Specifically, the measurement was performed by adding 0.1 ml to 0.5 ml of an alkylbenzene sulfonate surfactant as a dispersing agent to 100 ml to 150 ml of water from which solid impurities in the container had been previously removed, and then adding approximately 0.1 g to 0.5 g of the test portion. The suspension, in which the test portion was dispersed, was subjected to dispersion treatment for approximately 1 minute to 3 minutes by an ultrasonic disperser, and the toner formation was measured by the above apparatus at a dispersion concentration of 3,000 number/μl to 10,000 number/μl.

3. Particle Fluidity

The bulk density of the toner was measured by Powder Tester (the manufacture: Hosokawa Micron Corporation). The better fluidity of toner is, the more bulk density of the toner is.

4. The Lowest Fixing Temperature (° C.)

The copying test was carried out on Type-6200 Paper (the manufacturer: Ricoh Company Limited) by the modified fixer of Copier imagio NEO 450 (the manufacturer: Ricoh Company Limited) as a fixing roller. The lowest fixing temperature was defined as a temperature at which a survival rate of the image density was 70% or more after rubbing the fixed image with a pat. Here, the metal cylinder of the used fixing roller was formed of Fe and has a thickness of 0.34 mm. The bearing stress was adjusted to $1.0\times10^5$ Pa.

5. Hotoffset Occurring Temperature (HOT)

Fixing was evaluated in the same manner of the above lowest fixing temperature, and occurrence of hot offset to the fixing image was visually evaluated. Hot offset occurring temperature was defined as a temperature of the fixing roller at which hot offset occurred.

6. Heat-Resistant Storability

Heat-resistant storability was defined as a survival ratio of toner in which the toner was stored at 50° C. for 8 hours and sieved with a 42 mesh for 2 minutes. Better the heat-resistant storability of toner is, less the survival ratio is. Heat-resistant storability was evaluated with following 4 stages. "Poor" is when the survival ratio is 30% or more. "Fair" is when the survival ratio is 20% to 30%. "Good" is when the survival ratio is 10% to 20%. "Very Good" is when the survival ratio is less than 10%.

The evaluated results are shown in Table 1.

EXAMPLE 2

(Synthesis of Resin)

In an identical manner to that of Example 1, 334 parts of bisphenol A ethylene oxide bimolar adduct, 334 parts of bisphenol A propylene oxide bimolar adduct, 274 parts of isophthalic acid and 20 parts of anhydrous trimellitic acid were condensation polymerized, and reacted with 154 parts of isohorone diisocyanate to obtain a pre-polymer (2). Next, 213 parts of the prepolymer (2), 9.5 parts of isohorone diamine and 0.5 parts of dibutylamine were reacted in the same way as that of Example 1 to obtain a urea-modified polyester resin (2) having a weight average molecular weight of 52,000. 200 parts of the urea-modified polyester resin (2) and 800 parts of the non-modified polyester resin (a) were dissolved in 2,000 parts of ethyl acetate/MEK (1/1) mixed solvent, and stirred to obtain an ethyl acetate solution f the resin (2). Part of this solution was dried under reduced pressure to isolate the resin (2). Tg was 65° C., the acid value was 10, and the peak molecular weight was 5,500.

(Preparation of Toner)

The identical procedure as that of Example 1 were followed except that the ester wax was replaced by 7 parts of de-free fatty acid carnauba wax (the acid value: 1.5) as wax, and the dissolution temperature and dispersion temperature were changed to 50° C. to obtain the toner (2) of the present invention having the volume average particle diameter of 5.8 μm (Dv/Dn: 1.11), and the circularity of 0.98.

The obtained toner was observed under a transmission electron microscope (TEM). In this toner, the occupied area ratio of the wax in the above region was 30%. Moreover, the wax was not existed on the surface of the toner particle, the existing amount of the wax in the surface portion of the toner particle was 79% by number, and dispersed wax particles having a diameter of 0.1 μm to 3.0 μm were 90% by number.

The evaluated results are shown in Table 1.

Comparative Example 1

(Synthesis of Resin)

354 parts of bisphenol A ethylene oxide bimolar adduct and 166 parts of isophthalic acid were subjected to condensation polymerization using 2 parts of dibutylene oxide as a catalyst to obtain resin (1) having a weight average molecular weight of 8,000. Tg was 57° C., the acid value was 15, and the peak molecular weight was 6,000.

(Preparation of Toner)

100 parts of the resin (1), 200 parts of an ethyl acetate solution, 10 parts of carbon black (BP1300, the manufacturer: Cabot Corporation), and 10 parts of polypropylene were introduced into a beaker, and stirred at 12,000 rpm at 50° C. by a TK homomixer to uniformly dissolve and disperse the ingredients. Thereafter, the toner was prepared in the same manner of Example 1, and the toner of comparative example (1) having a volume average particle diameter of 6.0 μm (Dv/Dn: 1.36) and the circularity of 0.95 was obtained.

The obtained toner was observed under a transmission electron microscope (TEM). In this toner, the occupied area ratio of the wax in the above region was 3%. Moreover, the wax was not existed on the surface of the toner particle, the existing amount of the wax in the surface portion of the toner particle was 55% by number, and dispersed wax particles having a diameter of 0.1 μm to 3.0 μm were 63% by number.

The evaluated results are shown in Table 1.

TABLE 1

| | Area ratio of wax | Particle Fluidity | Lowest Fixing Temperature | Hot | Heat Resistant Storability | Range of Fixing Temperature | Wax/Resin |
|---|---|---|---|---|---|---|---|
| Ex. 1 | 20 (%) | 0.27 | 110 (° C.) | 210 (° C.) | good | 100 (° C.) | 5/80 |
| Ex. 2 | 30 (%) | 0.25 | 120 (° C.) | 230 or more (° C.) | very good | 110 (° C.) | 5/80 |
| Com. 1 | 3 (%) | 0.27 | 140 (° C.) | 170 (° C.) | fair | 30 (° C.) | 10/100 |

EXAMPLE 3

(Synthesis of Pre-Polymer)

724 parts of bisphenol A ethylene oxide bimolar adduct, 250 parts of isophthalic acid, 24 parts of terephthalic acid, and 2 parts of dibutylene oxide were introduced in a flask equipped with a cooling tube, stirring rod and nitrogen supply tube, and were allowed to react at 230° C. under normal pressure for 5 hours. Thereafter, the resulted mixture was further reacted under a reduced pressure of 10 mmHg to 15 mmHg for 5 hours while dewatering. The reaction mixture was cooled to 160° C. and 32 parts of phthalic anhydride was added therein for 2 hours to react. The reaction mixture was further cooled to 80° C., was reacted with 188 parts of isophorone diisocyanate in ethyl acetate for 2 hours. A pre-polymer (3) containing an isocyanate group was hence prepared.

(Synthesis of Ketimine Compound)

30 parts of isophorone diamine and 70 parts of methyl-ethyl ketone were introduced into a flask equipped with a stirring rod and thermometer, and are allowed to react at 50° C. for 5 hours to obtain a ketimine compound (1).

(Synthesis of Non-Modified Polyester)

In the same manner to the above, 724 parts of bisphenol A ethylene oxide bimolar adduct and 276 parts of terephthalic acid are allowed to condensation polymerize. Next, the mixture is further reacted under the reduced pressure of 10 mmHg to 15 mmHg for 5 hours while dewatering to obtain a non-modified polyester (b). The peak molecular weight is 6,000, and the acid value was 3.8.

(Preparation of Toner)

15.4 parts of the pre-polymer (1), 64 parts of polyester (b) and 78.6 parts of ethyl acetate were introduced into a beaker, and were stirred and dissolved. Next, 8 parts of rice wax as wax, and 4 parts of copper phthalocyanine blue were added and stirred at 12,000 rpm at 60° C. by a TK homomixer to uniformly dissolve and disperse the ingredients. Then, 2.7 parts of the ketimine compound (1) is added and dissolved to obtain a toner material solution (1). 706 parts of ion exchange water, 294 parts of a 10% suspension of hydroxyapatite (Supertite 10, the manufacture: Japan Chemical Industries) and 0.2 parts of a sodium dodceyl benzene sulfonate were introduced into the beaker, and uniformly dissolved. Next, the temperature was raised to 60° C., and the above toner material solution was introduced while stirring at 12,000 rpm in the TK homomixer for 10 minutes. Thereafter, the mixed solution was left to stand for 2 hours to stabilize. Next, this mixed solution was transferred to a flask equipped with a stirring rod and thermometer, the temperature was raised to 98° C. to remove the solvent while inducing urea reaction. Subsequently, the product was filtered, rinsed and dried, and graded by air power to obtain toner particles. The volume average particle diameter was 4.3 μm. Next, 0.5 parts of hydrophobic silica was added to 100 parts of the toner particles and mixed in a Henschel mixer to obtain the toner (5) of the present invention.

The obtained toner was observed under a transmission electron microscope (TEM). The ratio of volume average particle diameter to number average particle diameter (Dv/Dn) is 1.08, the circularity is 0.94, the peak molecular weight is 6,000, and Tg is 62° C. In this toner, the occupied area ratio of the wax in the above region was 20%. Moreover, the wax was not existed on the surface of the toner particle, the existing amount of the wax in the surface portion of the toner particle was 90% by number, and dispersed wax particles having a diameter of 0.1 μm to 3.0 μm were 88% by number.

The results are evaluated in the same manner to that of Example 1, and evaluated results are shown in Table 2.

EXAMPLE 4

(Synthesis of Pre-Polymer)

In the same manner of Example 1, 669 parts of bisphenol A ethylene oxide bimolar adduct, 274 parts of isophthalic acid, and 20 parts of trimellitic anhydride were condensation polymerized, and thereafter the resulted product was reacted with 154 parts of isophorone diisocyanate to pre-polymer (4) having volume average molecular weight of 15,000.

(Preparation of Toner)

15.5 parts of the pre-polymer (2), 64 parts of polyester (b) and 78.8 parts of ethyl acetate were introduced into a beaker, and were stirred and dissolved. Next, 5 parts of montan wax as wax, and 4 parts of copper phthalocyanine blue were added and stirred at 12,000 rpm at 50° C. by a TK homomixer to uniformly dissolve and disperse the ingredients. Then, 2.4 parts of the ketimine compound (1) and 0.036 parts of dibutyl amine were added and dissolved to obtain a toner material solution (2). The identical procedure as that of Example 3 were followed except that the toner material solution (1) was replaced by the toner material solution (2), and the dispersion temperature was changed to 50° C. to obtain the toner (6) of the present invention having the volume average particle diameter of 7.2 μm (Dv/Dn: 1.15), and the circularity of 0.98.

The obtained toner was observed under a transmission electron microscope (TEM). In this toner, the occupied area ratio of the wax in the above region was 25%. Moreover, the wax was not existed on the surface of the toner particle, the existing amount of the wax in the surface portion of the toner particle was 92% by number, and dispersed wax particles having a diameter of 0.1 μm to 3.0 μm were 94% by number. Tg is 60° C. and the peak molecular weight is 4,000.

The results are evaluated in the same manner to that of Example 1, and evaluated results are shown in Table 2.

EXAMPLE 5

The identical procedure as that of Example 4 were followed except that the amount of the montan wax was changed from 5 parts to 6.5 parts, and the time for standing was changed from 2 hours to 30 minutes to obtain the toner (7) of the present invention having the volume average particle diameter of 6.7 μm (Dv/Dn: 1.19), and the circularity of 0.98.

The obtained toner was observed under a transmission electron microscope (TEM). In this toner, the occupied area ratio of the wax in a region on an arbitrary cross-section of the toner particle having a center of the toner particle thereon, was 35%. Here, the region is positioned between the circumference of the toner particle and an inner circumference having a radius 1 μm shorter than that of the circumference. Moreover, the wax was not existed on the surface of the toner particle, the existing amount of the wax in the surface portion of the toner particle was 65% by number, and dispersed wax particles having a diameter of 0.1 μm to 3.0 μm were 65% by number. Tg is 60° C. and the peak molecular weight is 4,000.

The results are evaluated in the same manner to that of Example 1, and evaluated results are shown in Table 2.

COMPARATIVE EXAMPLE 2

(Synthesis of Resin)

354 parts of bisphenol A ethylene oxide bimolar adduct and 166 parts of terephthalic acid were subjected to condensation polymerize using 2 parts of dibutylene oxide as a catalyst to obtain a comparative resin (2) having a peak average molecular weight of 8,000.

(Preparation of Toner)

100 parts of the comparative resin (2), 200 parts of an ethyl acetate solution, 4 parts of copper phthalocyanine blue, and 5 parts of polypropylene were introduced into a beaker, and stirred at 12,000 rpm at 50° C. by a TK homomixer to uniformly dissolve and disperse the ingredients. Thereafter, the toner was prepared in the same manner of Example 4, and the comparative toner (2) having a volume average particle diameter of 6.9 μm (Dv/Dn: 1.45) and the circularity of 0.94 was obtained.

The obtained toner was observed under a transmission electron microscope (TEM). In this toner, the occupied area ratio of the wax in a region on an arbitrary cross-section of the toner particle having a center of the toner particle thereon, was 45%. Here, the region is positioned between the circumference of the toner particle and an inner circumference having a radius which is two-third of a radius of the circumference. Moreover, the wax was not existed on the surface of the toner particle, the existing amount of the wax in the surface portion of the toner particle was 65% by number, and dispersed wax particles having a diameter of 0.1 μm to 3.0 μm were 68% by number.

The results are evaluated in the same manner to that of Example 1, and evaluated results are shown in Table 2.

TABLE 2

| | Area ratio of wax | Particle Fluidity | Lowest Fixing Temperature | Hot | Heat Resistant Storability | Range of Fixing Temperature | Wax/Resin |
|---|---|---|---|---|---|---|---|
| Ex. 3 | 20 (%) | 0.26 | 130 (° C.) | 220 (° C.) | good | 90 (° C.) | 5/79.4 |
| Ex. 4 | 25 (%) | 0.29 | 120 (° C.) | 230 or more (° C.) | very good | 110 (° C.) | 5/79.5 |

TABLE 2-continued

| | Area ratio of wax | Particle Fluidity | Lowest Fixing Temperature | Hot | Heat Resistant Storability | Range of Fixing Temperature | Wax/Resin |
|---|---|---|---|---|---|---|---|
| Ex. 5 | 35 (%) | 0.24 | 120 (° C.) | 210 (° C.) | good | 90 (° C.) | 6.5/79.5 |
| Com. 2 | 45 (%) | 0.16 | 150 (° C.) | 230 or more (° C.) | poor | 80 (° C.) | 5/100 |

EXAMPLE 6

(Preparation of Toner)

15 parts of the pre-polymer (1), 85 parts of polyester (c) and 100 parts of ethyl acetate were introduced into a beaker, and were stirred and dissolved. Next, 9 parts of carnauba wax as wax, and 4 parts of copper phthalocyanine blue were added and stirred at 12,000 rpm at 60° C. by a TK homomixer to uniformly dissolve and disperse the ingredients. Then, 2.7 parts of the ketimine compound (1) is added and dissolved to obtain a toner material solution (1). 706 parts of ion exchange water, 294 parts of a 10% suspension of hydroxyapatite (Supertite 10, the manufacture: Japan Chemical Industries) and 0.2 parts of a sodium dodecylbenzene sulfonate were introduced into the beaker, and uniformly dissolved. Next, the temperature was raised to 60° C., and the above toner material solution was introduced while stirring at 12,000 rpm in the TK homomixer for 10 minutes. Thereafter, the mixed solution was left to stand at 40° C. for 5 minutes. Next, this mixed solution was transferred to a flask equipped with a stirring rod and thermometer, the temperature was raised to 98° C. to remove the solvent while inducing urea reaction. Subsequently, the product was filtered, rinsed and dried, and graded by air power to obtain toner particles. The volume average particle diameter of the toner particles was 6 aim. Next, 0.5 parts of hydrophobic silica and 0.5 parts of hydrophobic titanium oxide were added to 100 parts of the toner particles and mixed in a Henschel mixer to obtain the toner (6) of the present invention.

The obtained toner was observed under a transmission electron microscope (TEM). In this toner, the occupied area ratio of the wax in a region on an arbitrary cross-section of the toner particle having a center of the toner particle thereon, was 12%. Here, the region is positioned between the circumference of the toner particle and an inner circumference having a radius 1 μm shorter than that of the circumference. Moreover, the ratio of the wax existed in the surface portion of the toner particle and the wax existed in the centric portion of the toner particle was 5/4, and dispersed wax particles having a diameter of 0.1 μm to 3.0 μm were 85% by number. The volume average particle diameter was 6.0 μm (Dv/Dn: 1.08), the circularity is 0.94, the peak molecular weight is 6,000, and Tg is 62° C.

The evaluated results are shown in Table 3.

EXAMPLE 7

(Preparation of Toner)

15 parts of the pre-polymer (1), 85 parts of polyester (c) and 100 parts of ethyl acetate were introduced into a beaker, and were stirred and dissolved. Next, 8 parts of carnauba wax as wax, and 4 parts of copper phthalocyanine blue were added and stirred at 12,000 rpm at 60° C. by a TK homomixer to uniformly dissolve and disperse the ingredients. Then, 2.7 parts of the ketimine compound (1) is added and dissolved to obtain a toner material solution (1). 706 parts of ion exchange water, 294 parts of a 10% suspension of hydroxyapatite (Supertite 10, the manufacture: Japan Chemical Industries) and 0.2 parts of a sodium dodecylbenzene sulfonate were introduced into the beaker, and uniformly dissolved. Next, the temperature was raised to 60° C., and the above toner material solution was introduced while stirring at 12,000 rpm in the TK homomixer for 10 minutes. Thereafter, the mixed solution was left to stand at 40° C. for 30 minutes. Next, this mixed solution was transferred to a flask equipped with a stirring rod and thermometer, the temperature was raised to 98° C. to remove the solvent while inducing urea reaction. Subsequently, the product was filtered, rinsed and dried, and graded by air power to obtain toner particles. The volume average particle diameter of the toner particles was 6 μm. Next, 0.5 parts of hydrophobic silica and 0.5 parts of hydrophobic titanium oxide were added to 100 parts of the toner particles and mixed in a Henschel mixer to obtain the toner (7) of the present invention.

The obtained toner was observed under a transmission electron microscope (TEM). In this toner, the occupied area ratio of the wax in the above region was 12%. Moreover, the ratio of the wax existed in the surface portion of the toner particle to the wax existed in the centric portion of the toner particle was 5/3, and dispersed wax particles having a diameter of 0.1 μm to 3.0 μm were 82% by number. The volume average particle diameter was 6.1 μm (Dv/Dn: 1.08), the circularity is 0.98, the peak molecular weight is 6,000, and Tg is 62° C.

The evaluated results are shown in Table 3.

EXAMPLE 8

(Preparation of Toner)

15 parts of the pre-polymer (1), 85 parts of polyester (c) and 100 parts of ethyl acetate were introduced into a beaker, and were stirred and dissolved. Next, 7 parts of carnauba wax as wax, and 4 parts of copper phthalocyanine blue were added and stirred at 12,000 rpm at 60° C. by a TK homomixer to uniformly dissolve and disperse the ingredients. Then, 2.7 parts of the ketimine compound (1) is added and dissolved to obtain a toner material solution (1). 706 parts of ion exchange water, 294 parts of a 10% suspension of hydroxyapatite (Supertite 10, the manufacture: Japan Chemical Industries) and 0.2 parts of a sodium dodecylbenzene sulfonate were introduced into the beaker, and uniformly dissolved. Next, the temperature was raised to 60° C., and the above toner material solution was introduced while stirring at 12,000 rpm in the TK homomixer for 10 minutes. Thereafter, the mixed solution was left to stand at 40° C. for 60 minutes. Next, this mixed solution was transferred to a flask equipped with a stirring rod and thermometer, the temperature was raised to 98° C. to remove the solvent while inducing urea reaction. Subsequently, the product was filtered, rinsed and dried, and graded by air power to obtain toner particles. Next, 0.5 parts of hydrophobic silica and 0.5 parts of hydrophobic titanium oxide were added to 100 parts of the toner particles and mixed in a Henschel mixer to obtain the toner (8) of the present invention.

The obtained toner was observed under a transmission electron microscope (TEM). In this toner, the occupied area ratio of the wax in the above region was 12%. Moreover, the ratio of the wax existed in the surface portion of the toner particle to the wax existed in the centric portion of the toner particle was 5/2, and dispersed wax particles having a diameter of 0.1 μm to 3.0 μm were 86% by number. The volume average particle diameter was 5.9 μm (Dv/Dn: 1.06), the circularity is 0.97, the peak molecular weight is 6,000, and Tg is 62° C.

The evaluated results are shown in Table 3.

EXAMPLE 9

(Preparation of Toner)

15 parts of the pre-polymer (1), 85 parts of polyester (c) and 100 parts of ethyl acetate were introduced into a beaker, and were stirred and dissolved. Next, 6 parts of carnauba wax as wax, and 4 parts of copper phthalocyanine blue were added and stirred at 12,000 rpm at 60° C. by a TK homomixer to uniformly dissolve and disperse the ingredients. Then, 2.7 parts of the ketimine compound (1) is added and dissolved to obtain a toner material solution (1). 706 parts of ion exchange water, 294 parts of a 10% suspension of hydroxyapatite (Supertite 10, the manufacture: Japan Chemical Industries) and 0.2 parts of a sodium dodecylbenzene sulfonate were introduced into the beaker, and uniformly dissolved. Next, the temperature was raised to 60° C., and the above toner material solution was introduced while stirring at 12,000 rpm in the TK homomixer for 10 minutes. Thereafter, the mixed solution was left to stand at 40° C. for 90 minutes. Next, this mixed solution was transferred to a flask equipped with a stirring rod and thermometer, the temperature was raised to 98° C. to remove the solvent while inducing urea reaction. Subsequently, the product was filtered, rinsed and dried, and graded by air power to obtain toner particles. Next, 0.5 parts of hydrophobic silica and 0.5 parts of hydrophobic titanium oxide were added to 100 parts of the toner particles and mixed in a Henschel mixer to obtain the toner (9) of the present invention.

The obtained toner was observed under a transmission electron microscope (TEM). In this toner, the occupied area ratio of the wax in the above region was 12%. Moreover, the ratio of the wax existed in the surface portion of the toner particle to the wax existed in the centric portion of the toner particle was 5/1, and dispersed wax particles having a diameter of 0.1 μm to 3.0 μm were 85% by number. The volume average particle diameter was 6.3 μm (Dv/Dn: 1.08), the circularity is 0.96, the peak molecular weight is 6,000, and Tg is 62° C.

The evaluated results are shown in Table 3.

COMPARATIVE EXAMPLE 3

(Preparation of Toner)

15 parts of the pre-polymer (1), 85 parts of polyester (c) and 100 parts of ethyl acetate were introduced into a beaker, and were stirred and dissolved. Next, 5 parts of carnauba wax as wax, and 4 parts of copper phthalocyanine blue were added and stirred at 12,000 rpm at 60° C. by a TK homomixer to uniformly dissolve and disperse the ingredients. Then, 2.7 parts of the ketimine compound (1) is added and dissolved to obtain a toner material solution (1). 706 parts of ion exchange water, 294 parts of a 10% suspension of hydroxyapatite (Supertite 10, the manufacture: Japan Chemical Industries) and 0.2 parts of a sodium dodecylbenzene sulfonate were introduced into the beaker, and uniformly dissolved. Next, the temperature was raised to 60° C., and the above toner material solution was introduced while stirring at 12,000 rpm in the TK homomixer for 10 minutes. Thereafter, the mixed solution was left to stand at 50° C. for 60 minutes. Next, this mixed solution was transferred to a flask equipped with a stirring rod and thermometer, the temperature was raised to 98° C. to remove the solvent while inducing urea reaction. Subsequently, the product was filtered, rinsed and dried, and graded by air power to obtain toner particles. Next, 0.5 parts of hydrophobic silica and 0.5 parts of hydrophobic titanium oxide were added to 100 parts of the toner particles and mixed in a Henschel mixer to obtain the comparative toner (3) for the present invention.

The obtained toner was observed under a transmission electron microscope (TEM). In this toner, the occupied area ratio of the wax in the above region was 12%. Moreover, the ratio of the wax existed in the surface portion of the toner particle to the wax existed in the centric portion of the toner particle was 5/0, and dispersed wax particles having a diameter of 0.1 μm to 3.0 μm were 92% by number. The volume average particle diameter was 6.2 μm (Dv/Dn: 1.09), the circularity is 0.97, the peak molecular weight is 6,000, and Tg is 62° C.

The evaluated results are shown in Table 3.

COMPARATIVE EXAMPLE 4

(Preparation of Toner)

15 parts of the pre-polymer (1), 85 parts of polyester (c) and 100 parts of ethyl acetate were introduced into a beaker, and were stirred and dissolved. Next, 10 parts of carnauba wax as wax, and 4 parts of copper phthalocyanine blue were added and stirred at 12,000 rpm at 60° C. by a TK homomixer to uniformly dissolve and disperse the ingredients. Then, 2.7 parts of the ketimine compound (1) is added and dissolved to obtain a toner material solution (1). 706 parts of ion exchange water, 294 parts of a 10% suspension of hydroxyapatite (Supertite 10, the manufacture: Japan Chemical Industries) and 0.2 parts of a sodium dodecylbenzene sulfonate were introduced into the beaker, and uniformly dissolved. Next, the temperature was raised to 60° C., and the above toner material solution was introduced while stirring at 12,000 rpm in the TK homomixer for 10 minutes. Next, this mixed solution was transferred to a flask equipped with a stirring rod and thermometer, the temperature was raised to 98° C. to remove the solvent while inducing urea reaction. Subsequently, the product was filtered, rinsed and dried, and graded by air power to obtain toner particles. Next, 0.5 parts of hydrophobic silica and 0.5 parts of hydrophobic titanium oxide were added to 100 parts of the toner particles and mixed in a Henschel mixer to obtain the comparative toner (4) for the present invention.

The obtained toner was observed under a transmission electron microscope (TEM). In this toner, the occupied area ratio of the wax in the above region was 12%. Moreover, the ratio of the wax existed in the surface portion of the toner particle to the wax existed in the centric portion of the toner particle was 5/5, and dispersed wax particles having a diameter of 0.1 μm to 3.0 μm were 77% by number. The volume average particle diameter was 6.1 μm (Dv/Dn: 1.08), the circularity is 0.96, the peak molecular weight is 6,000, and Tg is 62° C.

The evaluated results are shown in Table 3.

The results of the above Example 1 through 9, and Comparative Example 1 through 3 were evaluated in the same manner to that of Example 1 excluding followings and all the results are shown in Table 3 (3-1 and 3-2).

It should be noted that an average value of ten toner particles among the test sample is taken as a value of a result in order to adjust variation of wax distributions between toner particles.

(Evaluation of Toner Fusion)

The prepared toner was disposed in the modified My Copy M-5 (the manufacturer: Ricoh Company Limited). Printing was carried out at 10,000 times using a manuscript having an image area ratio of 6%. Thereafter, the occurrence of toner fusion on a developing roller for single-component developer was evaluated, and the toner deposition to the toner thickness-regulating member was also evaluated.

TABLE 3-1

| | Ex. 1 | Ex. 2 | Ex. 3 | Ex. 4 | Ex. 5 | Com. 1 | Com. 2 |
|---|---|---|---|---|---|---|---|
| Amount of wax (%) *1 | 86 | 79 | 90 | 92 | 65 | 55 | 65 |
| Amount of wax (%) *2 | 14 | 21 | 10 | 8 | 35 | 45 | 0 |
| Notes | — | — | — | — | — | — | exposure to the surface |
| Total amount of wax | 5 | 7 | 10 | 8 | 6.5 | 10 | 5 |
| Amount of resin | 120 | 120 | 79.4 | 79.5 | 79.5 | 100 | 100 |
| Toner fusion | non | non | non | non | non | | occurred |
| Range of fixing temperature (° C.) | 100 | 110 | 110 | 90 | 90 | 30 | 80 |

TABLE 3-2

| | Ex. 6 | Ex. 7 | Ex. 8 | Ex. 9 | Com. 3 | Com. 4 |
|---|---|---|---|---|---|---|
| Amount of wax (%) *1 | 5 | 5 | 5 | 5 | 5 | 5 |
| Amount of wax (%) *2 | 4 | 3 | 2 | 1 | 0 | 5 |
| Total amount of wax | 9 | 8 | 7 | 6 | 5 | 10 |
| Amount of resin | 100 | 100 | 100 | 100 | 100 | 100 |
| Toner fusion | non | non | non | non | non | occurred |
| Range of fixing temperature (° C.) | 110 | 100 | 100 | 90 | 45 | 110 |

*1: Amount of the wax in the surface portion of the toner particle.
*2: Amount of the wax in the centric portion of the toner particle.

It can be found that the ratio of the amount of the wax in the surface potion of the toner particle to the amount of the wax in the centric portion is preferably 50/40 to 50/5. From the viewpoint of preventing toner fusion with only a small amount of wax, it is more preferably 50/30 to 50/10, and particularly preferably 50/20 to 50/10.

As has been seen in the above description, the present invention enables to obtain a toner that has a wide fixing region in a fixing apparatus of low energy consumption, an excellent storability, an excellent crack resistance and a minimum change of property in the case of cracking. Moreover, the present invention realizes an efficient process for manufacturing such toner. In the case that the toner of the present invention is used as a color toner, the present invention is excellent in glossiness and hot offset resistance, hence no oil needs to be applied onto a fixing roller.

Furthermore, the present invention has an excellent effect that a high resolution and highly detailed images can be obtained.

What is claimed is:

1. A toner for electrophotography, comprising:

a resin; and wax dispersed within the resin in a shape of fine particles so as to form a toner particle, wherein the dispersed wax particles are positioned in a whole portion of the toner particle and an existing amount of the wax in a surface portion of the toner is larger than an existing amount of the wax in a centric portion of the toner particle.

2. A toner for electrophotography, according to claim 1, wherein an occupied area ratio of the wax is 5% to 40% in a region on an arbitral cross-section having a center of the toner particle thereon, where the region is positioned between a circumference of the arbitral cross-section and an inner circumference having a radius which is two-third of a radius of the circumference.

3. A toner for electrophotography according to claim 1, wherein an existing amount of the wax, in a region on the arbitral cross-section, is 70% by number or more relative to a total existing amount of the wax on the arbitral cross-section, where the region is positioned between a circumference of the arbitral cross-section and an inner circumference a radius which is two-third of a radius of the circumference.

4. A toner for electrophotography according to claim 1, wherein the wax is not exposed from a surface of the toner particle.

5. A toner for electrophotography according to claim 1, wherein 70% by number or more of the dispersed wax particles has a diameter of 0.1 μm to 3 μm.

6. A toner for electrophotography according to claim 1, wherein a content of the wax is 3 parts by weight to 10 parts by weight relative to 100 parts by weight of the resin.

7. A toner for electrophotography according to claim 1, wherein the wax is at least one of free fatty acid eliminated carnauba wax, rice wax, montan wax, and ester wax.

8. A toner for electrophotography according to claim 1, wherein the resin is modified polyester.

9. A toner for electrophotography according to claim 8, wherein a toner composition including the modified polyester is one of dissolved and dispersed in an organic solvent and thereafter dispersed in an aqueous solvent so as to form the toner particle.

10. A toner for electrophotography according to claim 9, wherein polyester having a urea bonding is generated while a toner composition including a pre-polymer is one of dissolved and dispersed in an organic solvent and thereafter dispersed in an aqueous solvent so as to form the toner particle.

11. A toner for electrophotography according to claim 8, wherein the resin contains the modified polyester together with unmodified polyester and a weight ratio of the modified polyester to the unmodified polyester is 5/95 to 80/20.

12. A toner for electrophotography according to claim 1, wherein a peak molecular weight of the resin is 1,000 to 10,000.

13. A toner for electrophotography according to claim 1, wherein a glass transition temperature (Tg) of the resin is 40° C. to 70° C.

14. A toner for electrophotography according to claim 1, wherein a volume average diameter (Dv) of the toner is 3 μm to 8 μm, and a ratio (Dv/Dn) of the volume average diameter (Dv) to a number average diameter (Dn) of the toner is 1.00 to 1.20.

15. A toner for electrophotography according to claim 1, wherein an average circularity of the tone is 0.93 to 1.00.

16. A toner for electrophotography according to claim 1, wherein the toner particle has a spindle shape.

17. A toner for electrophotography, according to claim 16, wherein the toner particle has a spindle shape where a ratio (r2/r1) of a main axis r1 to a minor axis r2 is 0.5 to 0.8, and a ratio (r3/r2) of a thickness r3 to the minor axis r2 is 0.7 to 1.0.

18. A developer for electrophotography, comprising a toner which contains a resin and wax dispersed within the resin in a shape of fine particles so as to form a toner particle, wherein the dispersed wax particles are positioned in a whole portion of the toner particle and an existing amount of the wax in a surface portion of the toner is larger than an existing amount of the wax in a centric portion of the toner particle.

19. An image-forming apparatus, comprising:

an image developer containing a toner; and a fixer containing a pair of rollers, wherein a recording medium carrying an image formed of the toner thereon is passed through between the pair of rollers where a bearing stress (load of the rollers/contact area) of $1.5\times10^5$ Pa or less is applied, so as to heat and melt the toner in order to fix the image on the recording medium and the toner contains a resin and wax dispersed within the resin in a shape of fine particles so as to form a toner particle, wherein the dispersed wax particles are positioned in a whole portion of the toner particle and an existing amount of the wax in a surface portion of the toner is larger than an existing amount of the wax in a centric portion of the toner particle.

20. An image-forming apparatus according to claim 19, wherein the fixer contains a heating member which equips an exothermic body, a film which contacts with the heating member, and a pressurizing member which contacts the heating member via the film, and the recording medium carrying an image formed of the toner thereon is passed through between the film and the pressurizing member so as to fix the image.

21. An image-forming apparatus according to claim 19, further comprising an amorphous silicon photoconductor.

22. An image-forming apparatus according to claim 21, wherein the image developer equips a field printer which applies an alternating field.

23. An image-forming apparatus according to claim 21, further comprising a charger having a charging member, wherein the charging member is subjected to contact with a photoconductor and voltage is applied to the charging member so as to charge the photoconductor.

24. A process cartridge comprising:

a photoconductor; and at least one of a charger;

an image developer containing a toner; and a cleaner, wherein the process cartridge is replaceable from an image-forming apparatus, and the toner contains a resin and wax dispersed within the resin in a shape of fine particles so as to form a toner particle, wherein the dispersed wax particles are positioned in a whole portion of the toner particle and an existing amount of the wax in a surface portion of the toner is larger than an existing amount of the wax in a centric portion of the toner particle.

25. A image-forming process, comprising the steps of:

charging a photoconductor by externally applying a voltage;

forming a latent electrostatic image on the charged photoconductor;

developing the electrostatic image with a toner so as to form a toner image;

transferring the toner image onto a recording medium by a transfer;

cleaning the surface of the photoconductor by a cleaner after the step of transferring; and fixing the toner image on the recording medium by passing the recording material between a pair of rollers, wherein the toner contains a resin and wax dispersed within the resin in a shape of fine particles so as to form a toner particle, wherein the dispersed wax particles are positioned in a whole portion of the toner particle and an existing amount of the wax in a surface portion of the toner is larger than an existing amount of the wax in a centric portion of the toner particle.

* * * * *